US011672399B2

(12) United States Patent
Schnittman et al.

(10) Patent No.: US 11,672,399 B2
(45) Date of Patent: Jun. 13, 2023

(54) COVERAGE ROBOTS AND ASSOCIATED CLEANING BINS

(71) Applicant: iRobot Corporation, Bedford, MA (US)

(72) Inventors: Mark Steven Schnittman, Somerville, MA (US); Daniel N. Ozick, Newton, MA (US); Gregg W. Landry, Gloucester, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 17/670,963

(22) Filed: Feb. 14, 2022

(65) Prior Publication Data

US 2022/0167821 A1 Jun. 2, 2022

Related U.S. Application Data

(63) Continuation of application No. 16/269,251, filed on Feb. 6, 2019, now Pat. No. 11,246,466, which is a (Continued)

(51) Int. Cl.
*A47L 9/10* (2006.01)
*A47L 11/33* (2006.01)

(Continued)

(52) U.S. Cl.
CPC ..... *A47L 11/4013* (2013.01); *A47L 9/0477* (2013.01); *A47L 9/106* (2013.01);

(Continued)

(58) Field of Classification Search
CPC .... A47L 11/4013; A47L 9/0477; A47L 9/106; A47L 9/108; A47L 9/19; A47L 9/281;

(Continued)

(56) References Cited

U.S. PATENT DOCUMENTS 2,233,754 A 3/1941 Stern
2,275,356 A 3/1942 Truman (Continued)

FOREIGN PATENT DOCUMENTS

DE 1918565 10/1970
JP 2002306387 10/2002
WO WO 200211599 2/2020

OTHER PUBLICATIONS

"Facts on the Trilobite," Electrolux, accessed online <http://trilobite.electrolux.se/presskit_en/node1335.asp?print=yes&pressID=> Dec. 12, 2003, 2 pages.

(Continued)

*Primary Examiner* — David Redding
(74) *Attorney, Agent, or Firm* — Fish & Richardson P.C.

(57) ABSTRACT

An autonomous coverage robot includes a chassis, a drive system configured to maneuver the robot, and a cleaning assembly. The cleaning assembly includes a cleaning assembly housing and at least one driven sweeper brush. The robot includes a controller and a removable sweeper bin configured to receive debris agitated by the driven sweeper brush. The sweeper bin includes an emitter disposed on an interior surface of the bin and a receiver disposed remotely from the emitter on the interior surface of the bin and configured to receive an emitter signal. The emitter and the receiver are disposed such that a threshold level of accumulation of debris in the sweeper bin blocks the receiver from receiving emitter emissions. The robot includes a bin controller disposed in the sweeper bin and monitoring a detector signal and initiating a bin full routine upon determining a bin debris accumulation level requiring service.

20 Claims, 21 Drawing Sheets

Related U.S. Application Data continuation of application No. 13/892,453, filed on May 13, 2013, now Pat. No. 10,244,915, which is a continuation of application No. 11/751,267, filed on May 21, 2007, now Pat. No. 8,528,157.

(60) Provisional application No. 60/807,442, filed on Jul. 14, 2006, provisional application No. 60/803,504, filed on May 30, 2006, provisional application No. 60/747,791, filed on May 19, 2006.

(51) Int. Cl.

| | |
|---|---|
| ***A47L 9/28*** | (2006.01) |
| ***A47L 9/19*** | (2006.01) |
| ***A47L 11/40*** | (2006.01) |
| ***A47L 9/04*** | (2006.01) |
| ***A47L 11/24*** | (2006.01) |

(52) U.S. Cl.

CPC ..... *A47L 9/108* (2013.01); *A47L 9/19* (2013.01); *A47L 9/281* (2013.01); *A47L 11/24* (2013.01); *A47L 11/33* (2013.01); *A47L 11/4002* (2013.01); *A47L 11/4008* (2013.01); *A47L 11/4011* (2013.01); *A47L 11/4025* (2013.01); *A47L 11/4041* (2013.01); *A47L 11/4044* (2013.01); *A47L 11/4066* (2013.01); *A47L 11/4069* (2013.01); *A47L 11/4091* (2013.01); *A47L 11/4097* (2013.01); *A47L 2201/00* (2013.01); *A47L 2201/02* (2013.01); *A47L 2201/024* (2013.01); *A47L 2201/028* (2013.01); *A47L 2201/04* (2013.01)

(58) Field of Classification Search

CPC ..... A47L 11/24; A47L 11/33; A47L 11/4002; A47L 11/4008; A47L 11/4011; A47L 11/4025; A47L 11/4041; A47L 11/4044; A47L 11/4066; A47L 11/4069; A47L 11/4091; A47L 11/4097; A47L 2201/00; A47L 2201/02; A47L 2201/024; A47L 2201/028; A47L 2201/04

See application file for complete search history.

(56) References Cited

U.S. PATENT DOCUMENTS

| | | | |
|---|---|---|---|
| 2,409,230 | A | 10/1946 | Charles |
| 2,587,038 | A | 2/1952 | Goodell |
| 3,482,276 | A | 12/1969 | Fillery |
| 4,720,886 | A | 1/1988 | McLeod |
| 4,937,912 | A | 7/1990 | Kurz |
| 5,105,502 | A | 4/1992 | Takashima |
| 5,163,202 | A | 11/1992 | Kawakami et al. |
| 6,389,329 | B1 | 5/2002 | Colens |
| 6,532,404 | B2 | 3/2003 | Colens |
| 6,594,844 | B2 | 7/2003 | Jones |
| 6,690,134 | B1 | 2/2004 | Jones et al. |
| 6,732,826 | B2 | 5/2004 | Song et al. |
| 6,781,338 | B2 | 8/2004 | Jones et al. |
| 6,809,490 | B2 | 10/2004 | Jones et al. |
| 6,965,209 | B2 | 11/2005 | Jones et al. |
| 6,968,592 | B2 | 11/2005 | Takeuchi et al. |
| 7,155,308 | B2 | 12/2006 | Jones |
| 7,173,391 | B2 | 2/2007 | Jones et al. |
| 7,196,487 | B2 | 3/2007 | Jones et al. |
| 7,346,428 | B1 | 3/2008 | Huffman |
| 7,388,343 | B2 | 6/2008 | Jones et al. |
| 7,389,156 | B2 | 6/2008 | Ziegler et al. |
| 7,448,113 | B2 | 11/2008 | Jones et al. |
| 7,571,511 | B2 | 8/2009 | Jones et al. |
| 7,636,982 | B2 | 12/2009 | Jones et al. |
| 7,761,954 | B2 | 7/2010 | Ziegler |
| 8,087,117 | B2 | 1/2012 | Won et al. |
| 8,230,540 | B1 | 7/2012 | Nelson |
| 8,418,303 | B2 | 4/2013 | Kapoor et al. |
| 8,528,157 | B2 | 9/2013 | Schnittman et al. |
| 9,220,386 | B2 | 12/2015 | Gilbert, Jr. et al. |
| 10,244,915 | B2 | 4/2019 | Schnittman et al. |
| 10,646,091 | B2 | 5/2020 | Schnittman et al. |
| 11,246,466 | B2 | 2/2022 | Schnittman et al. |
| 2002/0016649 | A1 | 2/2002 | Jones |
| 2002/0120364 | A1 | 8/2002 | Colens |
| 2003/0025472 | A1 | 2/2003 | Jones et al. |
| 2004/0020000 | A1 | 2/2004 | Jones |
| 2004/0049877 | A1 | 3/2004 | Jones et al. |
| 2004/0187457 | A1 | 9/2004 | Colens |
| 2004/0207355 | A1 | 10/2004 | Jones et al. |
| 2005/0067994 | A1 | 3/2005 | Jones et al. |
| 2005/0150074 | A1 | 7/2005 | Diehl et al. |
| 2005/0162119 | A1 | 7/2005 | Landry et al. |
| 2005/0171636 | A1 | 8/2005 | Tani |
| 2005/0183229 | A1 | 8/2005 | Uehigashi |
| 2005/0183230 | A1 | 8/2005 | Uehigashi |
| 2005/0204505 | A1 | 9/2005 | Kashiwagi |
| 2005/0204717 | A1 | 9/2005 | Colens |
| 2006/0248676 | A1 | 11/2006 | Baek |
| 2007/0266508 | A1 | 11/2007 | Jones et al. |
| 2008/0047092 | A1 | 2/2008 | Schnittman et al. |
| 2008/0140255 | A1 | 6/2008 | Ziegler et al. |
| 2008/0155768 | A1 | 7/2008 | Ziegler et al. |
| 2008/0307590 | A1 | 12/2008 | Jones et al. |
| 2009/0044370 | A1 | 11/2009 | Won et al. |
| 2010/0049365 | A1 | 2/2010 | Jones et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2012/0079670 | A1 | 4/2012 | Yoon et al. |
| 2012/0159725 | A1 | 6/2012 | Kapoor et al. |
| 2012/0222224 | A1 | 9/2012 | Yoon et al. |
| 2013/0298350 | A1 | 11/2013 | Schnittman et al. |
| 2019/0167060 | A1 | 6/2019 | Schnittman et al. |
| 2019/0387946 | A1 | 12/2019 | Schnittman et al. |

OTHER PUBLICATIONS

"Welcome to the Electrolux Trilobite," Electrolux, accessed online <http://electroluxusa.com/node57.asp?currentURL=node142.asp%3F> Mar. 18, 2005, 2 pages.

Doty, K. L., and Harrison, R. R., Sweep Strategies for a Sensory-Driven, Behavior-Based Vacuum Cleaning Agent, AAAI 1993 Fall Symposium Series, Instantiating Real-World Agents, Research Triangle Park, Raleigh, NC, Oct. 22-24, 1993, pp. 1-6.

Everett, H.R. (1995). Sensors for Mobile Robots. AK Peters, Ltd., Wellesley, MA.

Hitachi: News release: The home cleaning robot of the autonomous movement type (experimental machine) is developed. May 29, 2003. Accessed online Mar. 18, 2005 <http://www.i4u.com/japanreleases/hitachirobot.htm> 5 pages.

Honda Motor Co., Ltd., English Translation of JP11212642, Aug. 9, 1999, 31 pages.

Jones, J., Roth, D. (Jan. 2, 2004). Robot Programming: A Practical Guide to Behavior-Based Robotics. McGraw-Hill Education TAB; 288 pages.

JP 2002306387, published Oct. 22, 2002, machine translation of JP 2002306387, 6 pages.

Karcher RC 3000 Robotic Cleaner, Product page, accessed online <http://www.karcher-usa.com/showproducts.php?op=view_prod&param1=143&param2=&param3=> Mar. 18, 2005, 3 pages.

Karcher RoboCleaner RC 3000, Dec. 12, 2003, 4 pages.

Karcher, Product Manual Download, 2003, 16 pages.

Neato Botvac™ User Manual, Neato Robotics, Sep. 11, 2014.

Prassler, et al., English Translation of DE19849978, Feb. 8, 2001, 16 pages.

COVERAGE ROBOTS AND ASSOCIATED CLEANING BINS

CROSS-REFERENCE TO RELATED APPLICATIONS

This U.S. patent application is a continuation of and claims priority under 35 U.S.C. § 120 to U.S. application Ser. No. 16/269,251, filed on Feb. 6, 2019, which is a continuation of and claims priority under 35 U.S.C. § 120 to U.S. application Ser. No. 13/892,453, filed on May 13, 2013, which is a continuation of and claims priority under 35 U.S.C. § 120 to U.S. application Ser. No. 11/751,267, filed on May 21, 2007, which claims priority under 35 U.S.C. § 119(e) to U.S. provisional patent applications 60/807,442, filed on Jul. 14, 2006; 60/803,504, filed on May 30, 2006; and 60/747,791, filed on May 19, 2006. The entire contents of the aforementioned applications are hereby incorporated by reference.

TECHNICAL FIELD

This disclosure relates to autonomous coverage robots and associated cleaning bins.

BACKGROUND

Autonomous robots are robots which can perform desired tasks in unstructured environments without continuous human guidance. Many kinds of robots are autonomous to some degree. Different robots can be autonomous in different ways. An autonomous coverage robot traverses a work surface without continuous human guidance to perform one or more tasks. In the field of home, office and/or consumer-oriented robotics, mobile robots that perform household functions such as vacuum cleaning, floor washing, patrolling, lawn cutting and other such tasks have been widely adopted.

SUMMARY

In one aspect, an autonomous coverage robot includes a chassis, a drive system mounted on the chassis and configured to maneuver the robot, and a cleaning assembly carried by the chassis. The cleaning assembly includes a cleaning assembly housing and at least one driven sweeper brush rotatably coupled to the cleaning assembly housing. The robot includes a controller carried by the chassis and a removable sweeper bin attached to the chassis. The sweeper bin is configured to receive debris agitated by the driven sweeper brush. The sweeper bin includes an emitter disposed on an interior surface of the bin and a receiver disposed remotely from the emitter on the interior surface of the bin. The receiver is configured to receive a signal emitted by the emitter. The emitter and the receiver are disposed such that a threshold level of accumulation of debris in the sweeper bin blocks the receiver from receiving emissions from the emitter. The robot includes a bin controller disposed in the sweeper bin and monitoring a signal from the detector and initiating a bin full routine upon determining a bin debris accumulation level requiring service.

Implementations of this aspect of the disclosure may include one or more of the following features. The cleaning bin is removably attached to the chassis. In some implementations, a diffuser is positioned over the emitter to diffuse the emitted signal. The receiver receives the diffused emissions. Accumulation of debris in the bin at least partially blocks the diffused emissions from being received by the receiver. The emitter may include an infrared light emitter diffused by a translucent plastic sheet. In some examples, the emitter is disposed on a first interior lateral surface of the bin and the receiver is disposed on an opposing, second interior lateral surface of the bin. The emitter and the receiver may be arranged for a determination of debris accumulation within substantially an entire volume of the bin. In some implementations, the coverage robot bin-full detection system includes a human perceptible indicator providing an indication that autonomous operation may be interrupted for bin servicing. The cleaning bin may include a vacuum assembly having an at least partially separate entrance path into the bin. In some examples, the cleaning bin includes a plurality of teeth disposed substantially along a mouth of the bin between a sweeper bin portion and a vacuum bin portion housing the vacuum assembly. The teeth are configured to strip debris from the rotating sweeper brush and the debris is allowed to accumulate in the sweeper bin portion.

In another aspect, a coverage robot bin-full detection system includes a cleaning bin housing configured to be received by a cleaning robot and a bin capacity sensor system carried by the cleaning bin housing. The bin capacity sensor system includes at least one signal emitter disposed on an interior surface of the cleaning bin housing and at least one signal detector disposed on the interior surface of the cleaning bin housing. The detector is configured to receive a signal emitted by the emitter. The coverage robot bin-full detection system includes a controller carried by the cleaning bin housing and a remote indicator in wireless communication with the controller. The controller monitors a signal from the detector and determines a cleaning service requirement. The remote indicator provides an indication of the cleaning service requirement determined by the controller.

Implementations of this aspect of the disclosure may include one or more of the following features. In some implementations, the cleaning bin housing defines a sweeper bin portion and a vacuum bin portion. The cleaning bin housing may include a vacuum assembly housed by the vacuum bin portion. The emitter may be an infrared light emitter. In some implementations, the controller is configured to determine a robot stuck condition and communicate the robot stuck condition to the wireless remote indicator. The remote indicator may be configured to communicate commands to the bin controller. The bin controller may communicate with a controller of the robot.

In yet another aspect, a method of detecting fullness of a cleaning bin of an autonomous coverage robot includes determining an empty bin threshold signal value by reading a signal received from a bin-fullness detection system while the cleaning bin is empty. After a predetermined period of time, the method includes detecting a present bin signal value by reading the signal from the detection system. The method includes comparing the empty bin threshold signal value with the present bin signal value to determine a signal value difference. Then the method includes, in response to determining that the signal difference is greater than a predetermined amount, activating a bin full indicator.

Implementations of this aspect of the disclosure may include one or more of the following features. The method may include periodically determining the check bin signal and the signal difference, wherein the indicator is activated when the check bin signals is greater than the empty bin threshold signal. The indicator may be activated when multiple check bin signals over the period of time are greater than the empty bin threshold signal. The emitter may be an infrared light emitter. In some examples, a diffuser positioned over the emitter to diffuse the emitted signal. In some implementations, the emitter is disposed on a first interior surface of the cleaning bin housing and the detector is disposed on an opposing, second interior surface of the cleaning bin housing.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
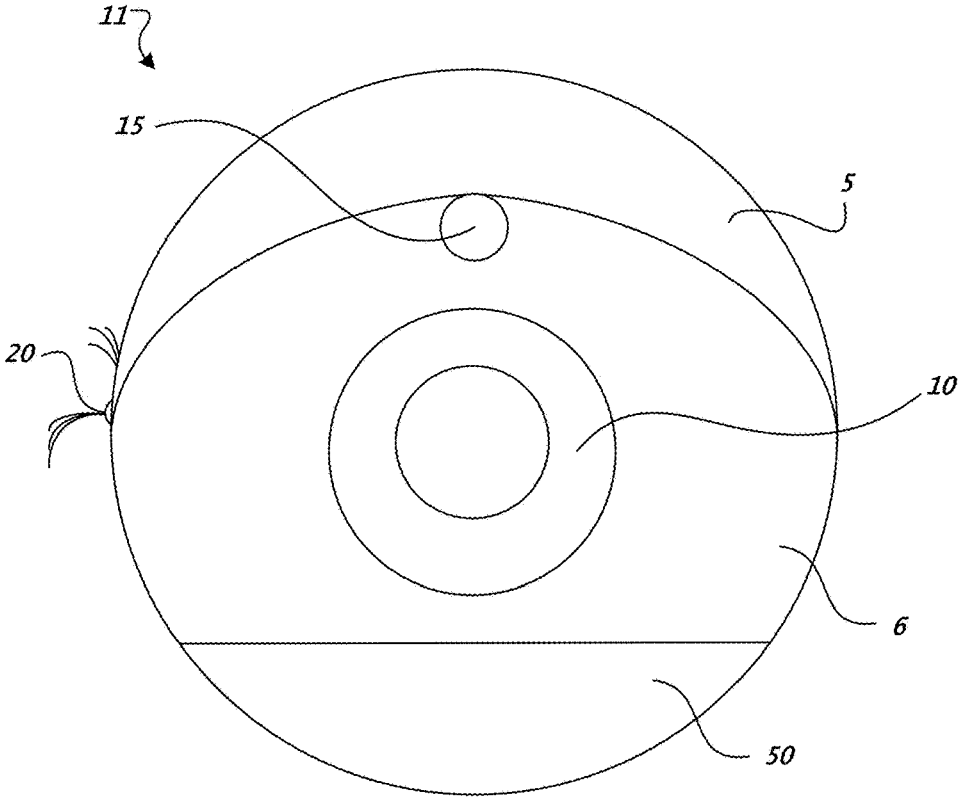
FIG. 1A is a top view of an autonomous robotic cleaner.

Referring to FIGS. 1A-1D, an autonomous robotic cleaner 11 includes a chassis 31 which carries an outer shell 6. FIG. 1A illustrates the outer shell 6 of the robot 11 connected to a bumper 5. An omnidirectional receiver 15 and a control panel 10 are both carried by the outer shell 6. The omnidirectional receiver 15 has a 360 degree line of vision that allowing detection of signals emitted towards the robot 11 from substantially all directions.

Figure 1B:
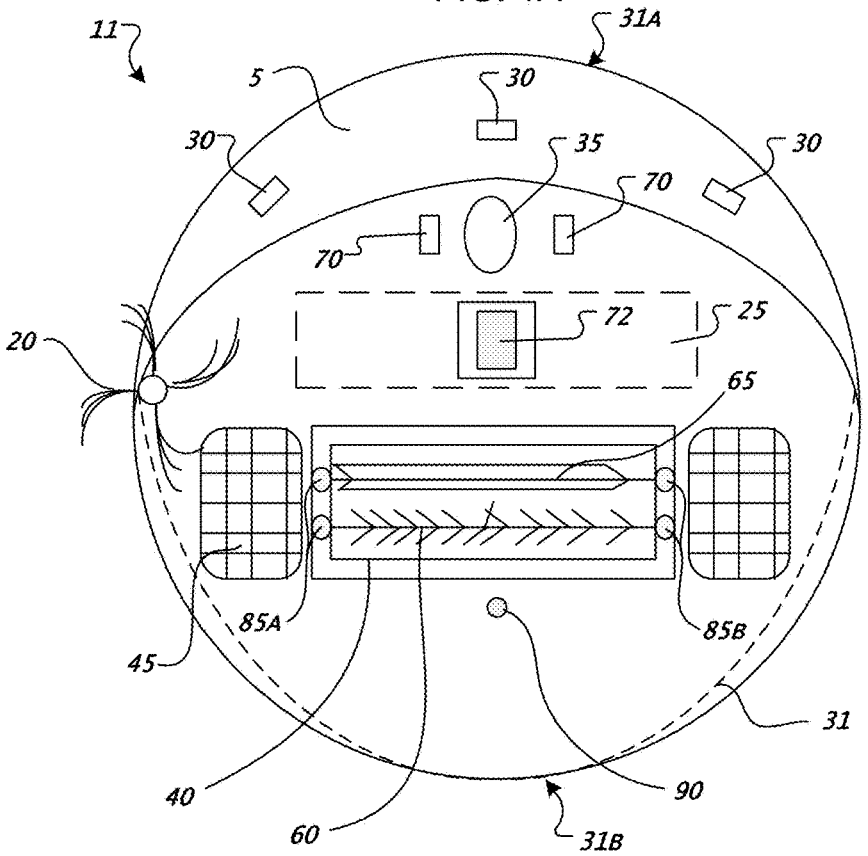
FIG. 1B is a bottom view of an autonomous robotic cleaner.

Referring to FIG. 1B, the robot 11 may move in forward and reverse drive directions; consequently, the chassis 31 has corresponding forward and back ends, 31A and 31B respectively. Infrared light (IR) cliff sensors 30 are installed on the underside of the robot 11 proximate the forward end 31A of the chassis 31. The cliff sensors 30 are configured to detect sudden changes in floor characteristics indicative of an edge or cliff of the floor (e.g. an edge of a stair). The forward end 31A of the chassis 31 includes a caster wheel 35 which provides additional support for the robot 11 as a third point of contact with the floor and does not hinder robot mobility. Located proximate to and on either side of the caster wheel 35 are two wheel-floor proximity sensors 70. The wheel-floor proximity sensors 70 are configured to detect sudden changes in floor characteristics indicative of an edge or cliff of the floor (e.g. an edge of a stair). The wheel-floor proximity sensors 70 provide redundancy should the primary cliff sensors 30 fail to detect an edge or cliff. In some implementations, the wheel-floor proximity sensors 70 are not included, while the primary cliff sensors 31 remain installed along the bottom front edge of the chassis 31. A lock assembly 72 on a bottom side of robot chassis 31 is configured to engage a corresponding lock assembly installed on a maintenance station for securing the robot 11 during servicing.

A cleaning head assembly 40 is located towards the middle of the robot 11 and installed within the chassis 31. The cleaning head assembly 40 includes a main 65 brush and a secondary brush 60. A battery 25 is housed within the chassis 31 proximate the cleaning head assembly 40. In some examples, the main 65 and/or the secondary brush 60 are removable. In other examples, the cleaning head assembly 40 includes a fixed main brush 65 and/or secondary brush 60, where fixed refers to a brush permanently installed on the chassis 31.

Installed along either side of the chassis 31 are differentially driven wheels 45 that mobilize the robot 11 and provide two points of support. Also installed along the side of the chassis 31 is a side brush 20 configured to rotate 360 degrees when the robot 11 is operational. The rotation of the side brush 20 allows the robot 11 to better clean areas adjacent the robot's side, and areas otherwise unreachable by the centrally located cleaning head assembly 40.

Figure 1C:
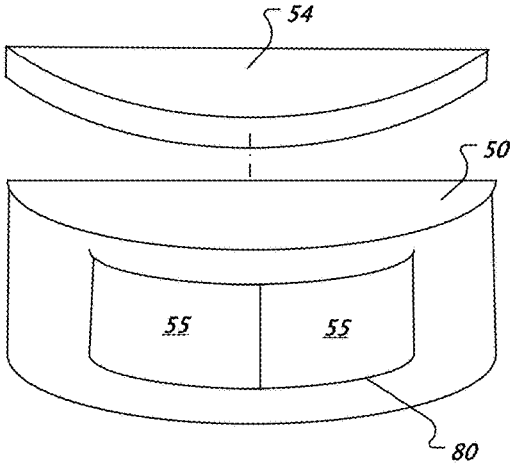
FIG. 1C is a side view of an autonomous robotic cleaner.

A removable cleaning bin 50 is located towards the back end 31B of the robot 11 and installed within the outer shell 6. The cleaning bin 50 is removable from the chassis 31 to provide access to bin contents and an internal filter 54. Additional access to the cleaning bin 50 may be provided via an evacuation port 80, as shown in FIG. 1C. In some implementations, the evacuation port 80 includes a set of sliding side panels 55 which slide along a side wall of the chassis 31 and under side panels of the outer shell 6 to open the evacuation port 80. The evacuation port 80 is configured to mate with corresponding evacuation ports on a maintenance station 1250. In other implementations, the evacuation port 80 is installed along an edge of the outer shell 6, on a top most portion of the outer shell 6, on the bottom of the chassis 31, or other similar placements where the evacuation port 80 has ready access to the contents of the cleaning bin 50.

In some implementations, the robot 11 includes a communication module 90 installed on the bottom of the chassis 31. The communication module 90 provides a communication link between a maintenance station 1250 and the robot 11. The communication module 90, in some instances, includes both an emitter and a detector, and provides an alternative communication path while the robot 11 is located within the maintenance station 1250. In some implementations, the robot 11 includes a brush service sensor assembly 85 installed on either side of and proximate the cleaning head 40. The brush service sensor assembly 85 provides user and system feedback regarding a degree of filament wound about the main brush 65, the secondary brush 60, or both. The brush service sensor assembly 85 includes an emitter 85A for emitting modulated beams and a detector 85B configured to detect the beams. The emitter 85A and the detector 86B are positioned on opposite sides of the cleaning head 60, 65 and aligned to detect filament wound about the cleaning head 60, 65. The brush service sensor assembly 85 includes a signal processing circuit configured to receive and interpret detector output. The emitter 85A is aligned along a rotating axis of the bush 60, 65 and between rows of bristles (or flaps) so that when no errant filaments are present on the bush 60, 65, a signal transmission between the emitter 85A and the detector 86B is not blocked. A presence of a few errant filaments spooled about the bush 60, 65 partially blocks a signal transmission between the emitter 85A and the detector 86B. When accumulation of errant filaments wrapped about the brush 60, 65 circumferentially and longitudinally reaches a certain threshold, a signal transmission between the emitter 85A and the detector 86B is substantially blocked by a corresponding threshold amount. Accumulation of errant filaments across the whole brush or locally in a ring clump are both detected at an appropriate time for maintenance.

Figure 2:
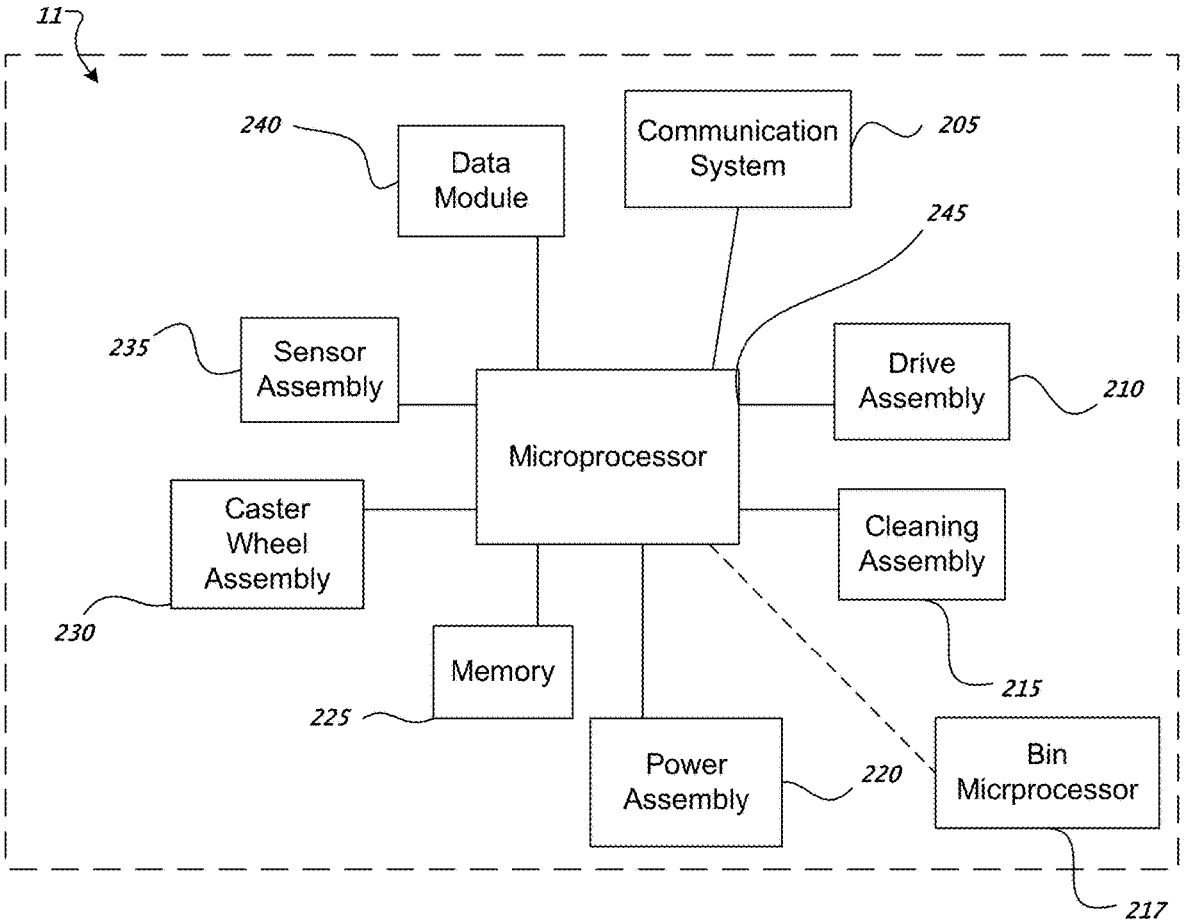
FIG. 2 is a block diagram of systems of an autonomous robotic cleaner.

FIG. 2 is a block diagram of systems included within the robot 11. The robot 11 includes a microprocessor 245 capable of executing routines and generating and sending control signals to actuators within the robot 200. Connected to the microprocessor 245 is memory 225 for storing routines and sensor input and output, a power system 220 with a battery 25 and a plurality of amplifiers able to generate and distribute power to the microprocessor 245, and other components included within the robot 11. A data module 240 is connected to the microprocessor 245 which may include ROM, RAM, an EEPROM or Flash memory. The data module 240 may store values generated within the robot 11 or to upload new software routines or values to the robot 11.

The microprocessor 245 is connected to a plurality of assemblies and systems, one of which is the communication system 205 including an RS-232 transceiver, radio, Ethernet, and wireless communicators. The drive assembly 210 is connected to the microprocessor 245 and includes right and left differentially driven wheels 45, right and left wheel motors, and wheel encoders. The drive assembly 210 is operable to receive commands from the microprocessor 245 and generate sensor data transmitted back to the microprocessor 245 via the communication system 205. A separate caster wheel assembly 230 is connected to the microprocessor 245 and includes a caster wheel 35 and a wheel encoder. The cleaning assembly 215 is connected to the microprocessor 245 and includes a primary brush 65, a secondary brush 60, a side brush 20, and brush motors associated with each brush. Also connected to the microprocessor is the sensor assembly 235 which may include infrared proximity sensors 75, an omnidirectional detector 15, mechanical switches installed in the bumper 5, wheel-floor proximity sensors 70, stasis sensors, a gyroscope, and infrared cliff sensors 30.

Figure 3A:
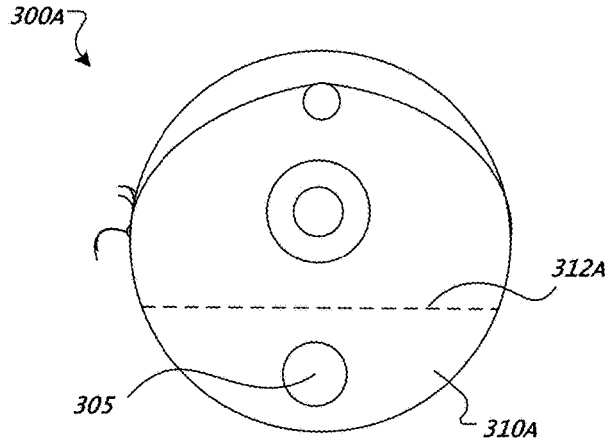
FIGS. 3A-3B are top views of autonomous robotic cleaners.

FIGS. 3A-3E illustrate various example locations of disposing the cleaning bin 50 and a filter 54 on the chassis 31 and the outer shell 6. FIG. 3A displays a robot 300A with an evacuation port 305 disposed on the top of the robot 300A, and more specifically installed on the top of a cleaning bin 310A. The cleaning bin 310A may or may not be removable from the chassis 31 and outer shell 6, and if removable, is removable such that the bin 310A separates from a back portion 312A of the robot 300A.

Figure 3B:
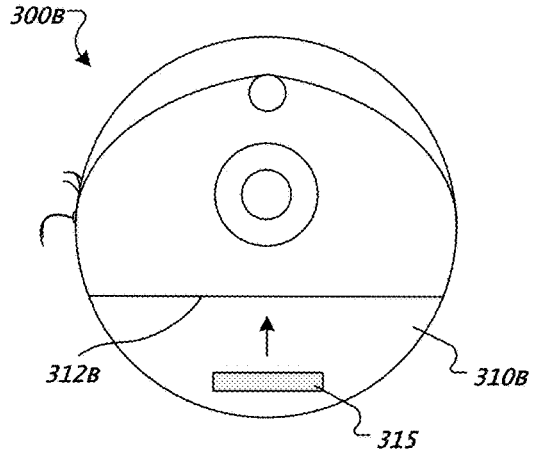

Referring to FIG. 3B, a cleaning bin 310B is installed towards the rearward end of a robot 310B and includes a latch 315. A top 311 of the cleaning bin 310B slides toward the forward end of the robot 310B when the latch 315 is manipulated, so that contents of the cleaning bin 310B can be removed. The outer shell 6 includes no latch for the removal of the filter 54. To access the filter 54, the cleaning bin 310B is removed from a back portion 312B of the robot 310B. In this implementation, the cleaning bin latch 315 may be manipulated manually by the operator or autonomously by a robotically driven manipulator.

Figure 3C:
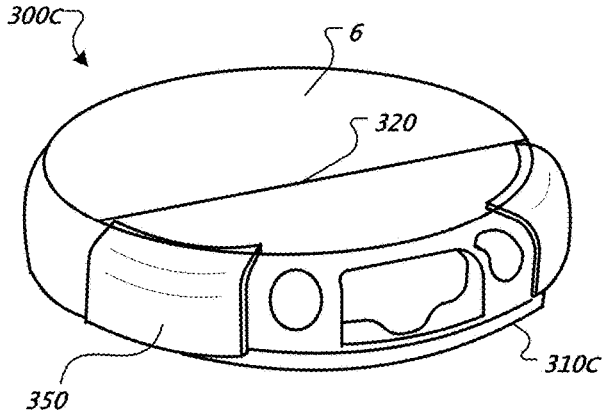
FIG. 3C is a rear perspective view of an autonomous robotic cleaner.

FIG. 3C illustrates a robot 300C including a cleaning bin 310C located on a rearmost side wall 320 of the outer shell 6. The cleaning bin 310C has a set of movable doors 350 that when actuated, slide along the side of the chassis 31 and under the outer shell 6. Once the doors 350 recess under the outer shell 6, the cleaning bin 310C is then configured to accept and mate with an external evacuation port.

Figure 3D:
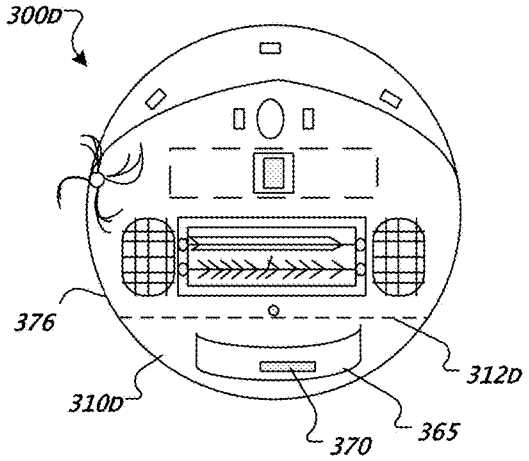
FIGS. 3D-3E are bottom views of autonomous robotic cleaners.

FIG. 3D provides a bottom view of a robot 300D and the bottom of the cleaning bin 310D located on the bottom back end of the robot 300D. The cleaning bin 310D has a latch 370 allowing a door 365 located on the bottom of cleaning bin 310D to slide towards the forward end of the robot 300D so that contents of the cleaning bin 310D may be removed. The filter 54 cannot be accessed from the outer shell 6. The cleaning bin 310D must be removed from a back portion 312D of the robot 300D to clean the filter 54. The cleaning bin 310D and latch 370 may be manipulated manually by an operator or autonomously by a robotically driven manipulator.

Figure 3E:
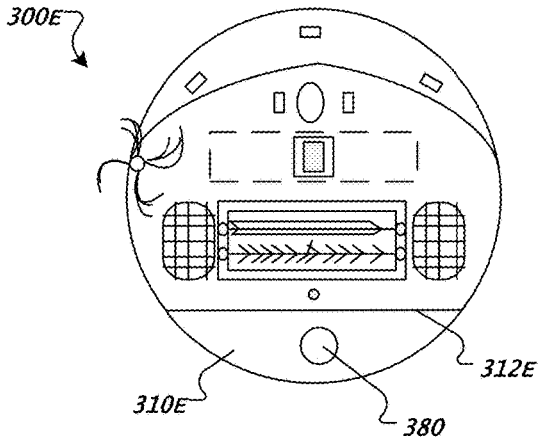

FIG. 3E provides a bottom view of a robot 300E and the floor of the cleaning bin 310E located on the bottom, back end of the robot 300E. The cleaning bin 310E includes a port 380 for accessing contents of the cleaning bin 310E. An evacuation hose may be attached to the port 380 to evacuate the cleaning bin 310E. The cleaning bin 310E must be removed from a back portion 312E of the robot 300D to access and clean the filter 54.

Figure 3F:
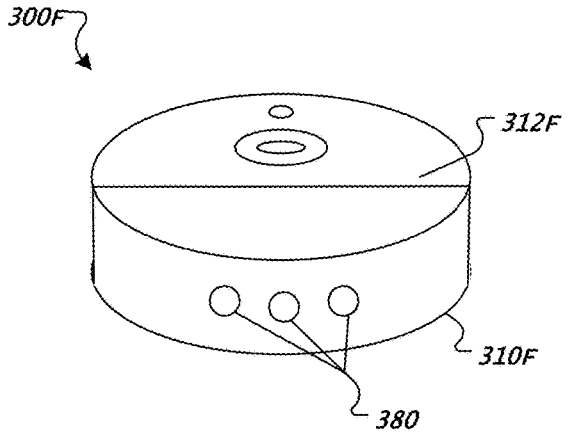
FIGS. 3F-3G are perspective views of an autonomous robotic cleaner.

Referring to FIG. 3F, a robot 300F includes a cleaning bin 310F located on a rear robot portion 312F. The cleaning bin 310F includes two or more evacuation ports 380 on a rear side (three are shown). The evacuation ports 380 are configured to receive an evacuation hose for removing debris from the bin 310F.

Figure 3G:
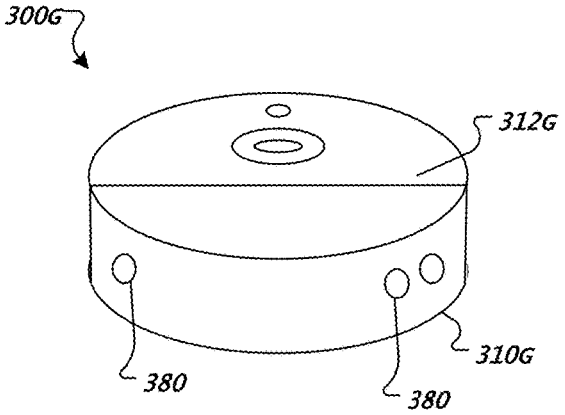

Referring to FIG. 3G, a robot 300G includes a cleaning bin 310G located on a rear robot portion 312G The cleaning bin 310G includes one or more evacuation ports 380 on a side portion (e.g. left and/or right sides). The evacuation ports 380 are configured to receive an evacuation hose for removing debris from the bin 310G.

Figure 4A:
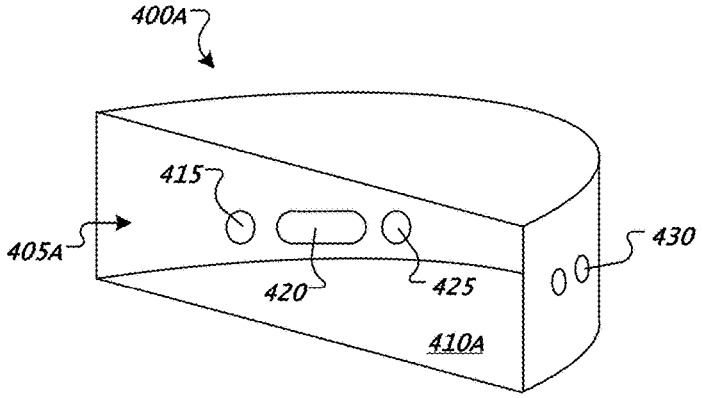
FIGS. 4A-4B are perspective views of removable cleaning bins.

The robotic cleaner 11 receives a number of different cleaning bins 50. Referring to FIG. 4A, a cleaning bin 400A is configured to mate with external vacuum evacuation ports. The vacuum bin 400A defines a main chamber 405A having a sloped floor 410A that aids movement of debris towards evacuation ports 415, 420, 425. A first side evacuation port 415 is located adjacent a center evacuation port 420 which is located between the first side evacuation port 415 and a second side evacuation port 425. Located on the side walls of the bin 400A are two evacuation outlets 430 that are installed to further aid a vacuum in its evacuation operation.

Figure 4B:
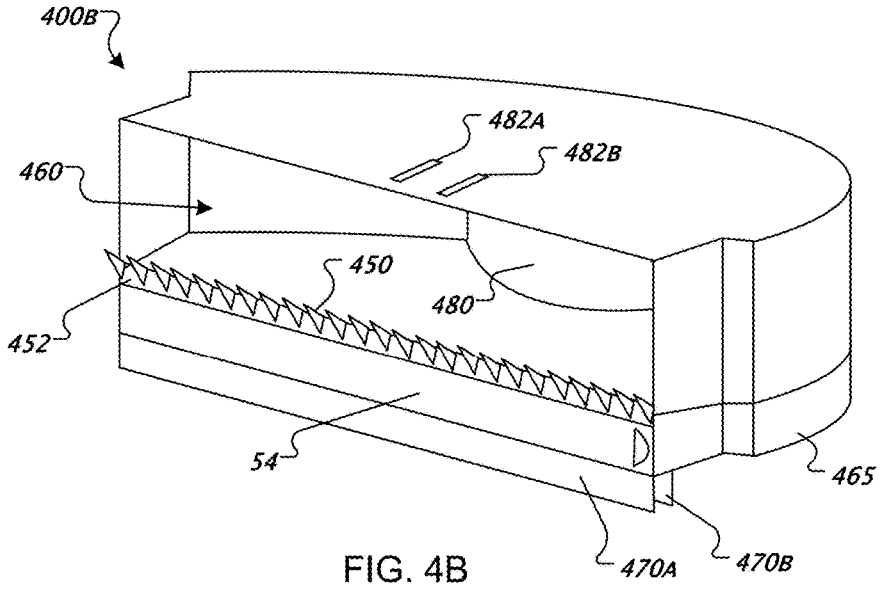

Referring to FIG. 4B, a bin 400B includes teeth 450 along a mouth edge 452 of the bin 400B. The teeth 450 reduce the amount of filament build up on the main brush 60 and/or the secondary brush 65 by placing the bin 400B close enough to the brush 60, 65 such that the teeth 492 slide under filament on the brush 60, 65 and pull off filament as the brush 60, 65 rotates. In some examples, the bin 400B includes between about 24-36 teeth. In the example shown, the bin 400B defines a sweeper bin portion 460 and a vacuum bin portion 465. The comb or teeth 450 are positioned between the sweeper bin portion 460 and the vacuum bin portion 465 and presented to lightly comb the sweeper brush 60. The comb or teeth 450 remove errant filaments from the sweeper brush 60 that accumulate either on the teeth 450 or in the sweeper bin portion 460. The vacuum bin portion 465 and the teeth 450 above it do not interfere with each other. The bin 400B carries a vacuum assembly 480 (e.g. a vacuum motor/fan) configured to draw debris past a pair of squeegees 470A and 470B in the vacuum bin portion 460. Electrical contacts 482A, 482B provide power to the vacuum assembly 480. In some examples, the electrical contacts 482A, 482B provide communication to a bin microprocessor 217. A filter 54 separates the vacuum bin portion 460 from the vacuum assembly 480. In some examples, the filter 54 pivots open along a side, top, or bottom edge for servicing. In other examples, the filter 54 slides out of the vacuum bin portion 460.

Figure 4C:
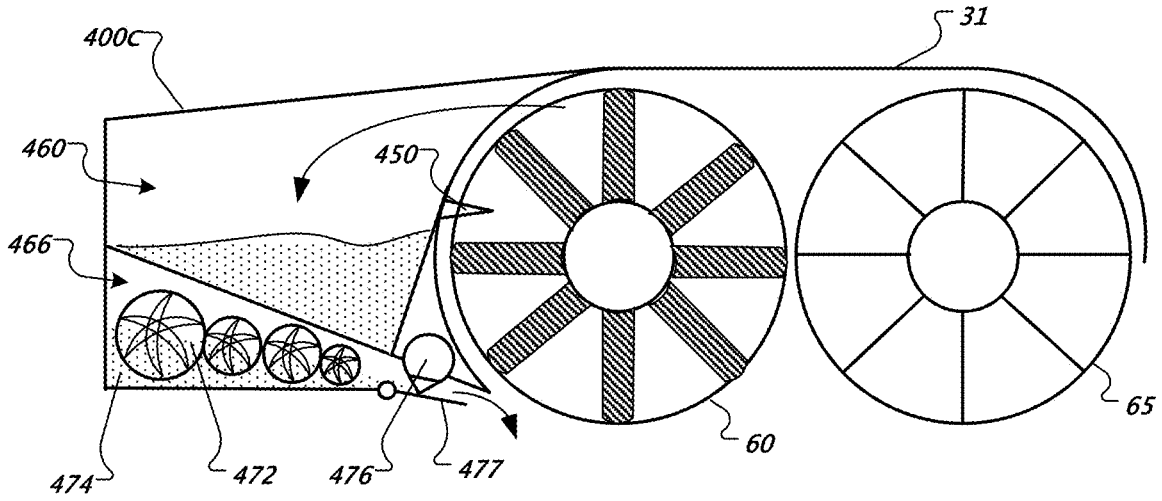
FIGS. 4C-4E are schematic views an autonomous robotic cleaner.

Referring to FIG. 4C, a bin 400C defines a sweeper bin portion 460 and a dispenser portion 466. The sweeper bin portion 460 is configured to receive debris agitated by the brush 60 and the flapper roller 65. The brush 60 and the flapper roller 65 may rotate in the same direction or opposite directions. The bin 400C includes driven vanes 472 configured to churn a substance 474 (e.g. powdered freshener) for dispersion. In some examples, a dispersion cam 476 (e.g. a single row of teeth on a rotatable shaft or roller) opens a spring biased flap 477 allowing the churned freshener to be disposed. In other examples, the dispersion cam 476 rotated among open and closed positions to control freshener dispersion. In some examples, the bin 400C includes teeth 450 disposed along a sweeper bin portion opening are configured to engage the brush 60 to remove filament and debris from the brush.

Figure 4D:
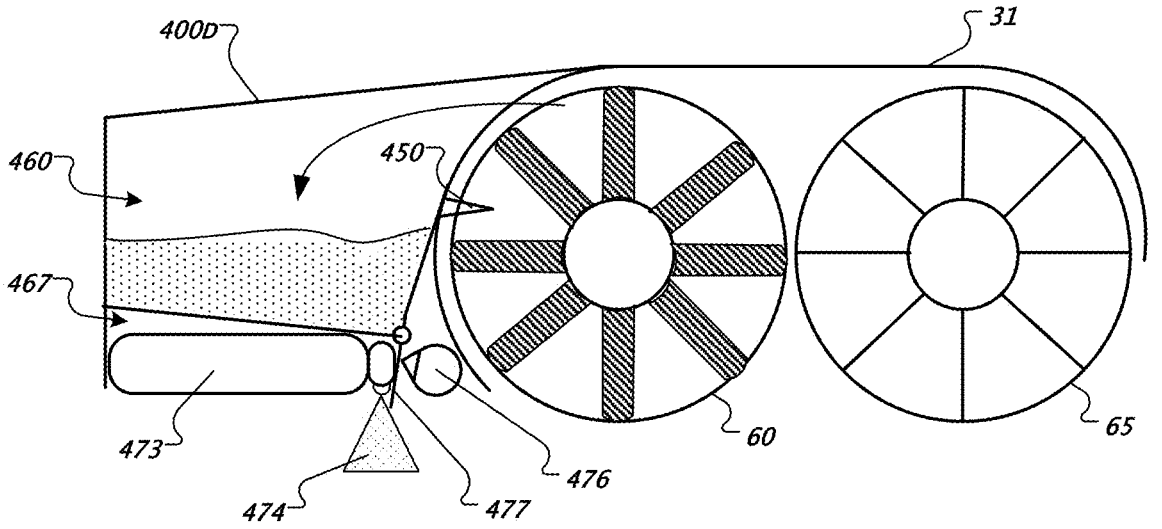

Referring to FIG. 4D, a bin 400D defines a sweeper bin portion 460 and a dispenser portion 467. The bin 400D includes a sprayer 473 configured to spray a substance 474 (e.g. liquid or powder freshener) when actuated by a dispersion cam 476. In some examples, the dispersion cam 476 rotates a spring biased flap 477 that actuates the sprayer 473.

Figure 4E:
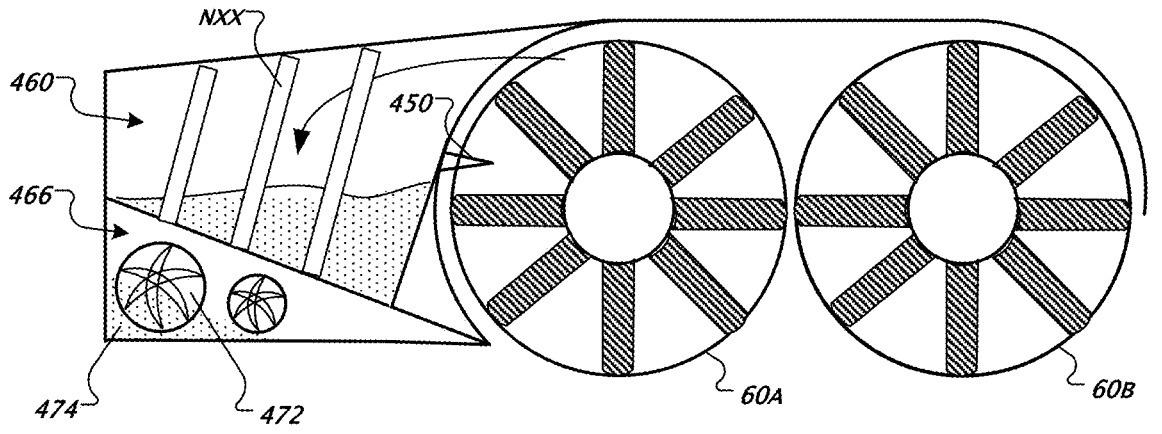

Referring to FIG. 4E, a bin 400E defines a sweeper bin portion 460 which includes at least one chased plate 468 configured to attract particulate or debris. In some examples, the bin 400E defines a dispenser portion 466 including driven vanes 472 configured to churn a substance 474 (e.g. powdered freshener) for dispersion. Air may be forced through dispenser portion 466 (e.g. via a fan) to treat the air.

Figure 5A:
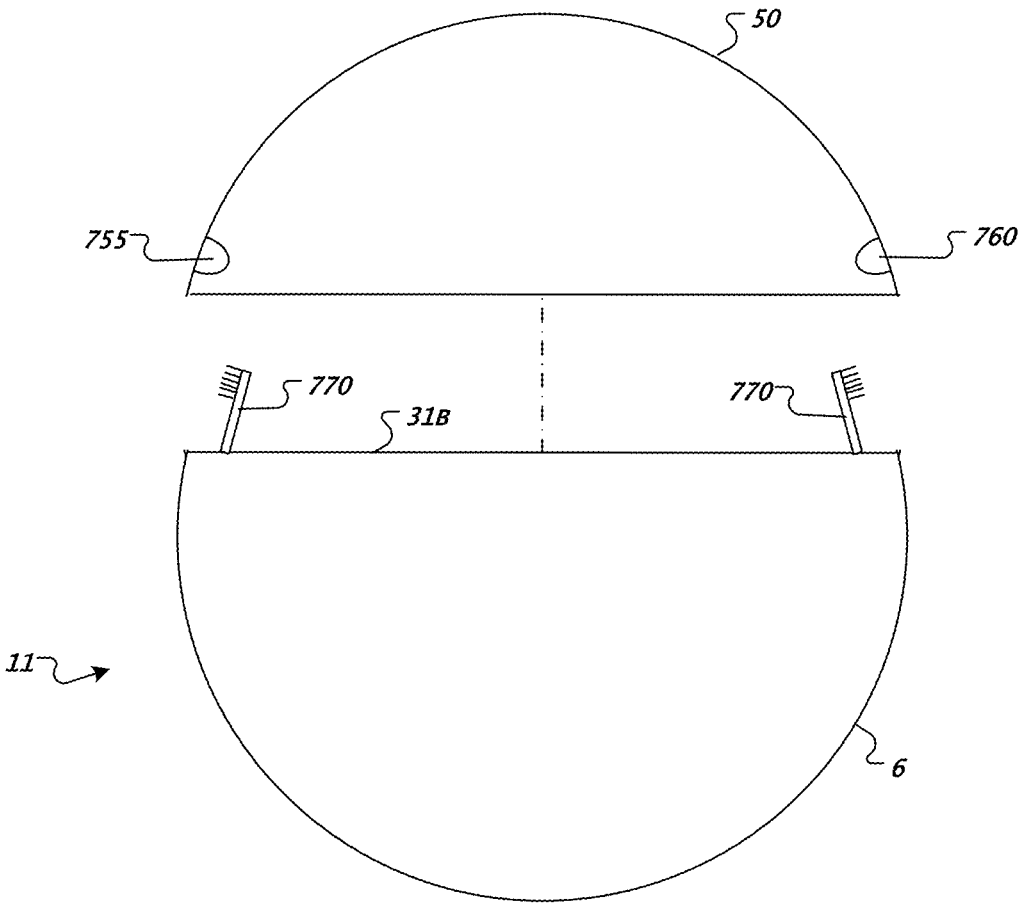
FIG. 5A is a top view of an autonomous robotic cleaner.
Figure 5B:
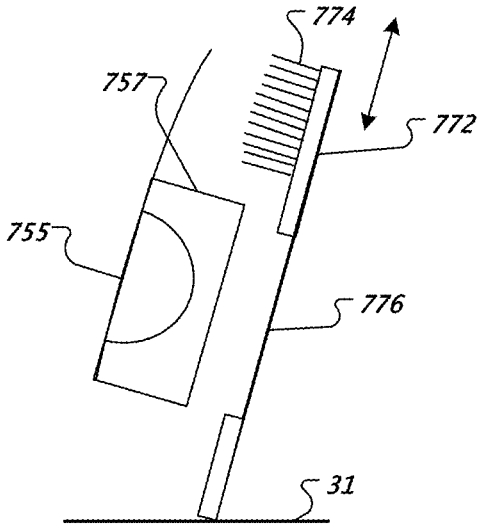
FIG. 5B is a top view of a bin sensor brush.

Referring to FIGS. 5A-5B, in some instances, the bin 50 includes a bin-full detection system 700 for sensing an amount of debris present in the bin 50. In one implementation, the bin-full detection system includes an emitter 755 and a detector 760 housed in the bin 50. A housing 757 surrounds each the emitter 755 and the detector 760 and is substantially free from debris when the bin 50 is also free of debris. In one implementation, the bin 50 is detachably connected to the robotic cleaner 11 and includes a brush assembly 770 for removing debris and soot from the surface of the emitter/detector housing 757. The brush assembly 770 includes a brush 772 mounted on the chassis 31 and configured to sweep against the emitter/detector housing 757 when the bin 50 is removed from or attached to the robot 11. The brush 772 includes a cleaning head 774 (e.g. bristles or sponge) at a distal end farthest from the robot 11 and a window section 776 positioned toward a base of the brush 772 and aligned with the emitter 755 or detector 760 when the bin 50 is attached to the robot 11. The emitter 755 transmits and the detector 760 receives light through the window 776. In addition to brushing debris away from the emitter 755 and detector 760, the cleaning head 774 prevents debris or dust from reaching the emitter 755 and detector 760 when the bin 50 is attached to the robot 11. In some examples, the window 776 comprises a transparent or translucent material and formed integrally with the cleaning head 774. In some examples, the emitter 755 and the detector 760 are mounted on the chassis 31 of the robot 11 and the cleaning head 774 and/or window 776 are mounted on the bin 50.

Figure 6A:
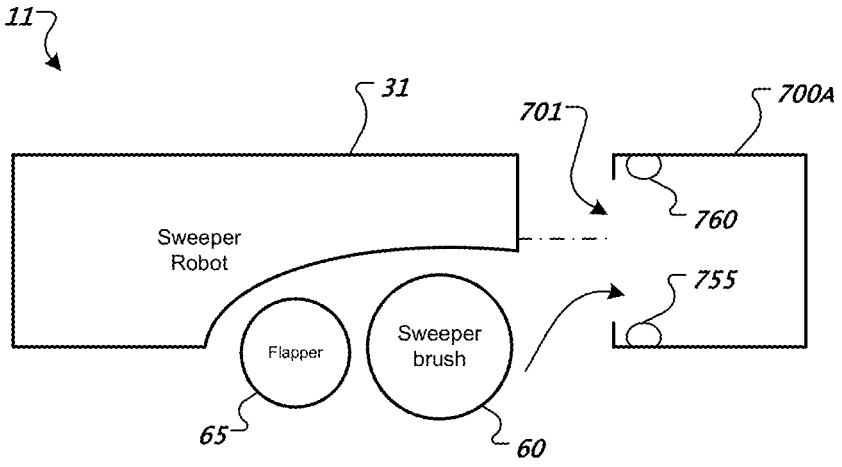
FIGS. 6A-6C are schematic views of autonomous robotic cleaners.
Figure 6B:
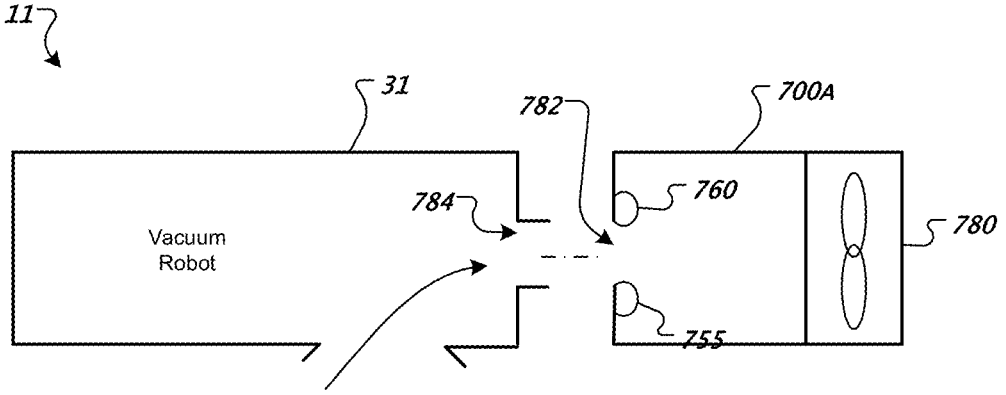

FIG. 6A illustrates a sweeper robot 11 including a brush 60 and a flap 65 that sweep debris into a bin 700A having an emitter 755 and a detector 760 both positioned near a bin mouth 701. FIG. 6B illustrates an implementation in which a bin 700B includes a vacuum/blower motor 780, and an emitter 755 and a detector 760 located near an inlet 782 of a vacuum flow path into the bin 700B. The chassis 31 of the robot 11 includes a robot vacuum outlet 784 that fits flush with the vacuum inlet 782 of the bin 700B. By placing the emitter 755 and the detector 760 near the debris inlet 782, the debris is measured along the intake flow path rather than within the debris chamber 785. Therefore, a bin-full condition is triggered when either the amount of debris swept or vacuumed along the flow path is extremely high (which may typically be a rare scenario), or when the debris chamber 785 is full (e.g. debris is no longer deposited therein, but instead backs up along the intake flow path near the inlet 782).

Figure 6C:
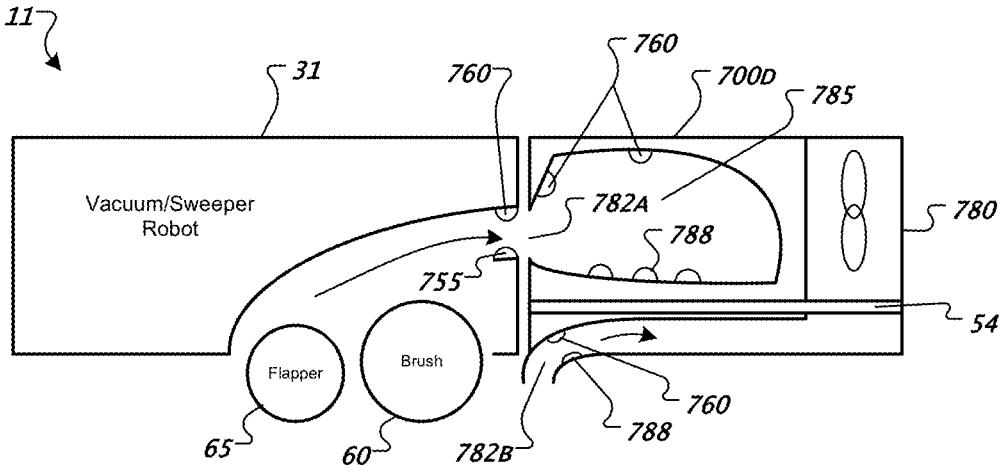

FIG. 6C illustrates a combined vacuum/sweeper bin 700C including an emitter 755 and a detector 760 pair positioned near a sweeper bin inlet 782A and a vacuum bin inlet 782B. An emitter 755 and a detector 760 are mounted on the chassis 31 of the robot 11 near the bin inlet 782. Alternatively to or in combination with the inlet sensors 755, 760, several emitter arrays 788 are positioned on a bottom interior surface of the bin 700C and one more detectors 760 are positioned on a top interior surface of the bin 700C. Signals from the detectors 760 located along the intake flow path, as well as the container of the bin 700C, may be compared for determining bin fullness. For example, when a heavy volume of debris is pulled into the bin 700C by the brush 60, flapper 65, and/or vacuum motor 780, the detectors 760 located along the flow path may generate a low detection signal. However, detectors 760 located on the top interior surface of the bin 700D will not detect a full bin 700C, if it is not yet full. Comparison of the detector signals avoids a false bin-full condition.

Figure 7A:
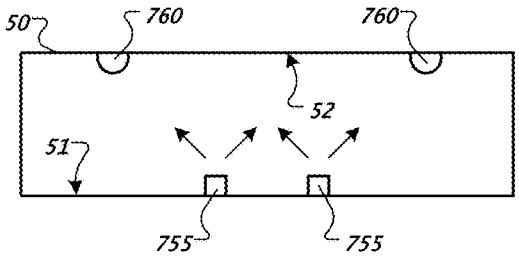
FIGS. 7A-7B are front views of removable cleaning bins.

FIGS. 7A-7E illustrate a transmissive optical debris-sensing system for detecting debris within the bin 50. As shown in FIG. 7A, in some examples, the bin 50 includes emitters 755 located on a bottom interior surface 51 of the bin 50 and detectors 760 located on an upper interior surface 52 of the bin 50. The emitters 755 emit light that traverses the interior of the bin 50 and which may be detected by the detectors 760. When the interior of the bin 50 is clear of debris, the transmitted light from the emitters 755 produces a relatively high signal strength in the detectors 760, because very little of the transmitted light is diverted or deflected away from the detectors 760 as the transmitted light passes through the empty interior of the bin 50. By contrast, when the interior of the bin 50 contains debris, at least some of the light transmitted from the emitters 755 is absorbed, reflected, or diverted as the light strikes the debris, such that a lower proportion of the emitted light reaches the detectors 760. The degree of diversion or deflection caused by the debris in the interior of the bin 50 correlates positively with the amount of debris within the bin 50.

By comparing the signals generated by the detectors 760 when the bin 50 does not contain debris to subsequent signal readings obtained by the detectors 760 as the robot 11 sweeps and vacuums debris into the bin 50 during a cleaning cycle, the presence of debris within the bin 50 may be determined. For example, when the subsequently polled detector signals are compared to initial detector signals (taken when the bin 50 is empty), a determination can be made whether the debris accumulated within the bin 50 has reached a level sufficient to trigger a bin-full condition.

One example bin configuration includes one emitter 755 and two detectors 760. Another configuration includes positioning one or more emitters 755 and detectors 760 in cross-directed in mutually orthogonal directions. The robot 11 may determine that heavy debris has accumulated on the bottom of the bin 50 but has not filled the bin 50, when signals generated by a first detector 760 on the inner top surface 52 is relatively low and signals generated by a second detector 760 on an inner side wall (which detects horizontally-transmitted light) does not meet a bin-full threshold. On the other hand, when both detectors 760 report a relatively low received-light signal, it may be determined that the bin 50 is full.

Figure 7B:
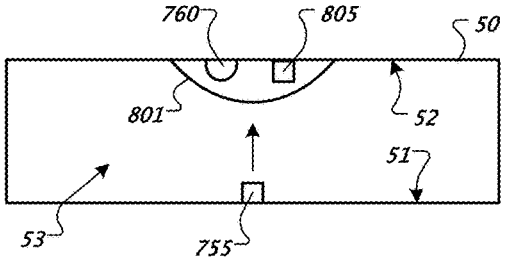

FIG. 7B illustrates a bin configuration in which the bin 50 includes a detector 760 located proximate a calibration emitter 805, both disposed behind a shield 801 on the top interior surface 52 of the bin 50. An emitter 755 is disposed on the bottom interior surface 51 of the bin 50. A calibration signal reading is obtained by emitting light from the calibration emitter 805 which is then detected by the detector 760 as a first reading. The translucent or transparent shield 801 prevents emission interfere between the transmission of light from the calibration emitter 805 to the detector 760 with dust or debris from the bin 50. The emitter 755 then transmits light across the interior of the bin 50 and the detector 760 takes a second reading of received light. By comparing the second reading to the first reading, a determination may be made whether the bin 50 is full of debris. In some examples, the robot 11 includes sensors 755, 760 positioned along a debris flow path prior to a mouth 53 of the bin 50. The bin full sensors 755, 760 may detect debris tending to escape from the bin 50.

Figure 7C:
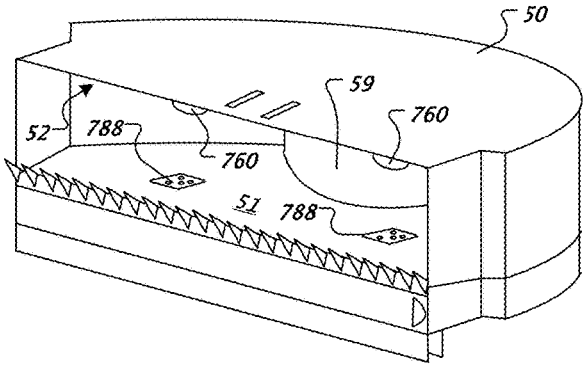
FIGS. 7C-7E are perspective views of removable cleaning bins.

FIG. 7C illustrates a configuration in which the bin 50 includes two emitter arrays 788 and two detectors 760. Each emitter array 788 may include several light sources. The light sources may each emit light frequencies that differ from one another within the same emitter arrays 788. For example, varying frequencies of light emitted by the light sources exhibit various levels of absorption by debris of different sizes. A first sub-emitter within the emitter array 788 may emit light at a first frequency, which is absorbed by debris of very small particle size, while a second sub-emitter within the emitter arrays 788 may emit light at a second frequency which is not absorbed by small-sized debris particles. The robot 11 may be determine whether the bin 50 is full even when the particle size of the debris varies by measuring and comparing the received light signals from the first and second sub-emitters. Undesirable interference with the optical transmissive detection system may be avoided by employing sub-emitters emitting light at different frequencies.

Multiple emitter arrays 788 and detectors 760 provide more accurate and reliable bin fullness detection. In the example shown, the multiple emitter arrays 788 provide cross-bin signals to detect potential bin blockages. One possible blockage location is near an intruding vacuum holding bulkhead 59, which partially divides the bin 50 into two lateral comportments. This does not apply to all bins 50. A blockage may occur when received artifact debris of a large enough size (e.g. paper or hairball) becomes a blocking and compartmentalizing bulkhead in the bin 50. A blockage may occur when shifting, clumping, moving, vibrated, or pushed debris within the bin creates one or more compartments via systematic patterns of accumulation. If debris accumulates in one lateral compartment, but not another, a single detector pair may miss it. A single detector pair may also provide a false-positive signal from a large debris item or clump. Multiple emitter arrays 788 located on the bottom interior surface 51 of the bin 50 and multiple detectors 760 located on the top interior surface 52 of the bin 50 in two different lateral or front-to-back locations covers more potential volume of the bin 50 for more accurate and reliable bin fullness detection. A histogram or averaging of the bin detector signals or using XOR or AND on the results of more than one break-beam may be used to get more true positives (even depending on the time since accumulation began).

Figure 7D:
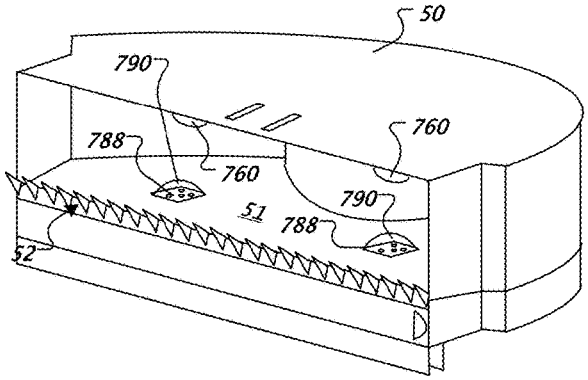

FIG. 7D illustrates a bin 50 with a transmissive optical detection system including two emitter arrays 788, each having a diffuser 790 diffusing emitted infrared light. The diffuse light transmitted to the interior of the bin 50 provides a steadier detection signal generated by the detectors 760 relative to a detection signal generated from a concentrated beam of light from a non-diffuse light source. The diffuse light provides a type of physical averaging of the emitted signal. The detectors 760 receiving diffused infrared light signals can measure an overall blockage amount versus interruption of only a line-of-sight break beam from one emitter.

Figure 7E:
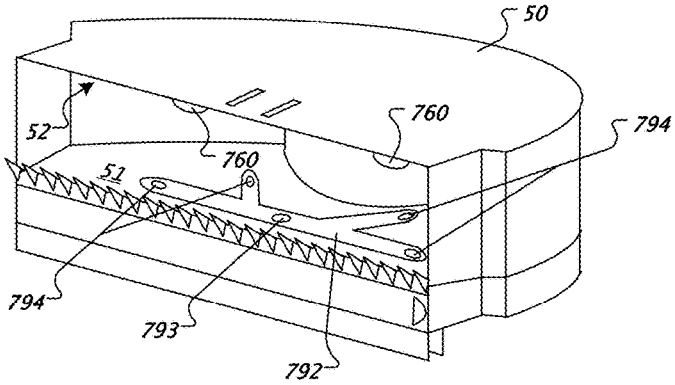

FIG. 7E illustrates a bin 50 including a light pipe or fiber-optic pathway 792 disposed on the bottom interior surface 51 of the bin 50. Light from a light source 793 in the bin 50 travels along the fiber-optic pathway 792 and is emitted from distributor terminals 794. This bin configuration centralizes light production to the single light source 793, rather than supplying power to several independent light sources, while distributes light across the bin 50. The distributor terminals 794 may also include a diffuser 790, as discussed above.

Figure 7F:
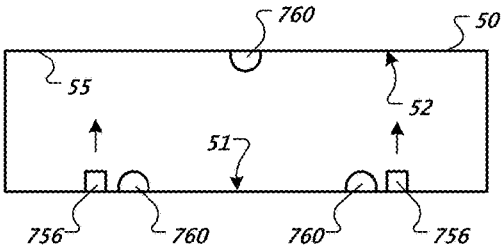
FIGS. 7F-7H are front views of removable cleaning bins.
Figure 7G:
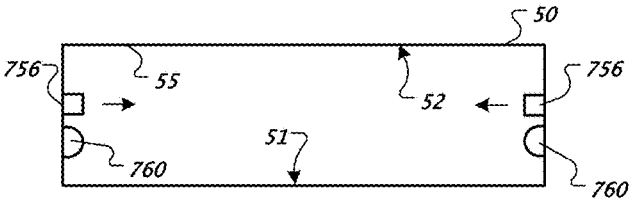
Figure 7H:
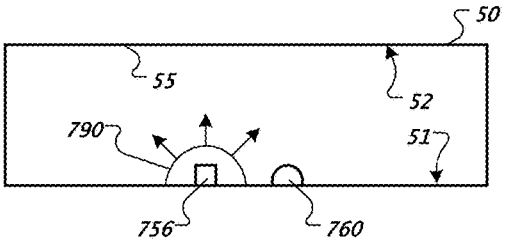

FIGS. 7F-7H illustrate optical debris detection in the bin 50 by reflective light transmission. In one example, as illustrated in FIG. 7F, the bin 50 includes a shielded emitter 756 located near a detector 760. Light emitted by the shielded emitter 756 does not travel directly to the detector 760 because of the shielding. However, light emitted from the emitter 756 is reflected by the interior surface 55 of the bin 50, and traverses an indirect path to the detectors 760. The attenuation of the reflected light caused by debris within the bin 50 may be comparatively greater than in a direct transmissive configuration, because the path the reflected light must travel within the bin 50 is effectively doubled, for example. Although the shielded emitter 756 and detector 760 are illustrated as being proximal to each other, they may be located distally from each other. The emitter 756 and detector 760 may be positioned on the same surface, or on different surfaces.

FIG. 7G illustrates two sets of shielded emitters 756 and detectors 760, each located on opposite horizontal sides of the interior of the bin 50. In this configuration, light received by each detector 760 may be a combination of light directly transmitted from the shielded emitter 756 located on the opposite side of the bin 50, as well as light reflected off the interior surface 55 by the proximal shielded emitter 756. In some examples, a first set of shielded emitters 756 and detectors 760 is located on an adjacent bin surface from a second set of shielded emitters 756 and detectors 760. In one example, a single shielded emitter 756 and detector 760 pair is located on a bottom surface 51 of the bin 50.

FIG. 7H illustrates a configuration in which the bin 50 includes a diffusive screen 412 placed along the transmission path of the shielded emitter 756 disposed on a bottom surface 51 of the bin 50. The diffusive screen 790 diffuses light emitted from the shielded emitter 756 that reflects off various surfaces of the interior 55 of the bin 50 before reaching the detector 760, thereby providing a detection signal that reflects a broad area of the interior of the bin 50.

Figure 8A:
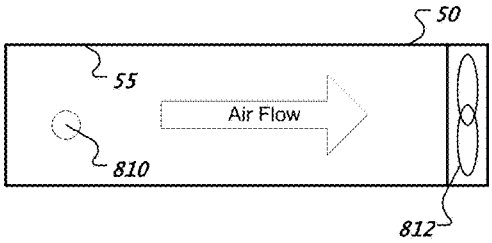
FIGS. 8A-8E are schematic views of removable cleaning bins.
Figure 8B:
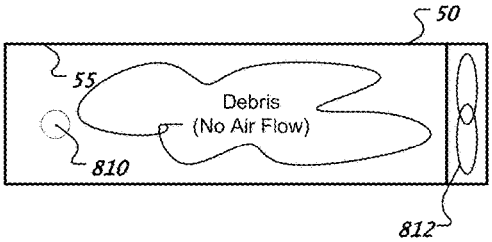

The robot 11, in some implementations, measures or detects air flow to determine the presence of debris within the bin 50. FIGS. 8A-8B illustrate an air flow detection system 800 for detecting a bin-full state. The bin 50 includes an air flow detector 810. As illustrated in FIG. 8A, when high air flow is detected by the air flow detector 810, the bin 50 determines that the interior is not full, because a high level of debris would obstruct air flow within the bin 50. Conversely, as illustrated in FIG. 8B, when the bin 50 contains a large quantity of debris, the air flow within the bin 50 stagnates. Therefore, air flow detected by the air flow detector 810 declines and the bin 50 determines that the debris level is full.

In some example, the bin 50 includes a rotating member 812 which influences an air volume to flow within the bin 50, guided by the inner surface 55 of the bin 50. The rotating member 812 may be disposed inside or outside of the bin 50 (anchored or free, e.g., a wire, a vane, a brush, a blade, a beam, a membrane, a fork, a flap). In some instances, the rotating member 812 is an existing fan or blower from which air is diverted. In other instances, the rotating member 812 includes a brush or paddle having a primary purpose of moving debris or particulates. The rotating member 812 may be diverted from a wheel chamber or other moving member chamber. "Rotation" and "rotating" as used herein, for sensors and/or cleaning members, includes transformations of rotation into linear motion, and thereby expressly includes reciprocating and sweeping movements. The air flow sensor 810 is disposed in the air volume that generates a signal corresponding to a change in an air flow characteristic within the bin 50 in response to a presence of material collected in the bin 50.

In some implementations, the air flow sensor 810 includes a thermal sensor 862, such as a thermistor, thermocouple, bimetallic element, IR photo-element, or the like. The thermal sensor 862 may have a long or short time constant, and can be arranged to measure static temperature, temperature change, rate of temperature change, or transient characteristics or spikes. The thermal sensor 862 may be passive, active, or excited. An example of a thermal sensor 862 that is excited is a self-heating thermistor, which is cyclically excited for a fixed time at a fixed voltage, in which the cooling behavior of the thermistor is responsive to air flow over the thermistor. Different thermistors and thermistor packaging may be used, e.g. beads or glass packages, having different nominal resistances and negative temperature coefficient of resistance vs. positive temperature coefficient of resistance.

Figure 8C:
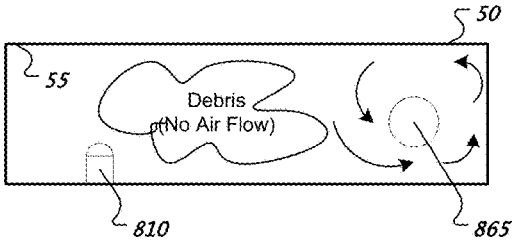

FIG. 8C illustrates a temperature sensing systems for detecting a bin-full state. In some examples, the bin 50 includes a self-heating thermistor 862 placed along an air flow path 864 from an air duct 865 of the bin 50. Air flow is generated by suction of a vacuum motor 880, for example. The thermistor 862 is heated to a predetermined temperature (e.g. by applying an electric current to a heating coil surrounding the thermistor 864). A predetermined period of time is permitted to elapse without applying further heating to the thermistor 862 before reading the thermistor temperature of the 862. When air flow within the bin 50 is relatively high, the temperature detected by the thermistor 862 is relatively low because the circulating air cools the thermistor 862. Conversely, when the air flow is stagnant, the temperature detected by the thermistor 862 is relatively high, because of less cooling of the thermistor 862. The robot 11 determines whether the bin 50 is full or not based on the relative temperature detected by the thermistor 862 following the heating and cooling-off cycle. Accuracy can be achieved by disposing two thermistors 862 in appropriate positions in the bin 50. A first thermistors 862 measures ambient temperature, and a second thermistors 862 to heat above the ambient temperature. Air flow generally dissipates heat generated by the thermistor 862. A lack of air flow typically relates to generally higher temperatures. Long thermal time constants associated with the temperature differences tend to result in good noise resistance and benefit from a built-in running averages effect, aggregating previous measurements automatically to produce a more accurate determination.

Placing the thermistor 862 in a location of the bin 50 empirically determined to have more or less air flow in general, it is possible to tune the sensitivity of air flow inference by the thermistors 862. The thermistor 862 may be shielded or define holes to obtain better air flow over the thermistor, enhancing thermistor sensitivity. The fluid dynamics of a bin 50 actively filling with randomly shaped debris and randomly perturbed air flow is inherently predictable, and routine experimentation is necessary to determine the best location for any sensors mentioned herein.

By adopting a total heating/cooling cycle time of about one minute (30 seconds heating, 30 seconds cooling, although this could be varied by an order of magnitude), the long thermal time constant of the system may prevent the thermistor 862 from responding too quickly. Air flow may also affect the time constant and the peak-to-peak change in temperature during cycling as well as reducing the long-term average temperature over many cycles.

Convection may be used if heating occurs at the bottom and temperature sensing at the top of the thermistor 862. Convection be used in the vacuum bin 50 to sense a clogged filter (usually equivalent to a full bin for the vacuum chamber, which tends to collect microscopic material only). Air flow decreases when the filter 54 is clogged. If the air flow decreases, a higher temperature change is produced. Alternatively, the slope of the heating/cooling cycle, averaged, may also be used to detect filter clogging and/or blocked air flow.

Figure 8D:
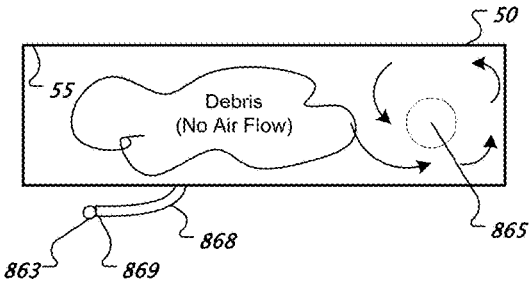

FIG. 8D illustrates a pressure sensing systems for detecting a bin-full state. In some implementations, the air flow sensor 810 includes a pressure transducer 863, which may have a long or short time constant. The pressure transducer 863 may be arranged to measure static pressure (e.g., strain gauge pressure transducer), overpressure, back pressure, pressure change, rate of pressure change, or transient characteristics or spikes (e.g., piezo pressure transducer). The pressure transducer 863 can be passive, active, or excited, and can be arranged to measure air flow directly or indirectly by Bernoulli/venturi principles (in which more flow past a venturi tube creates lower pressure, which can be measured transiently or on an averaged basis to infer low air flow and a full bin when a low pressure zone is not detected).

A relatively small air pathway 868 (herein a "Venturi tube") extends orthogonally from the interior surface 55 of the bin 50. The robot 11 determines bin fullness based on the relative pressure detected by the pressure transducer 863 at a distal end 869 of the Venturi tube 868. When air flow along the interior surface of the bin 50 is high, the pressure at the distal end 869 of the Venturi tube 868 is relatively low. The pressure readings may be combined with thermistor and/or optical sensor readings to more accurately determine the presence of debris, for example.

Figure 8E:
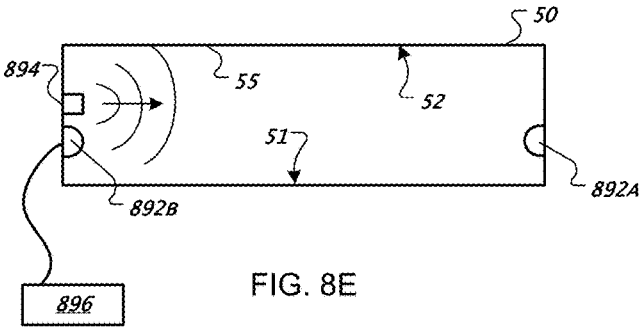

Referring to FIG. 8E, in some implementations, the bin 50 includes a vibration, resonance, or acoustic sensor 892 and an agitator or sonic emitter 894 configured to acoustically stimulate or perturb the bin 50, the air within the bin 50, or a sensing element provided in the bin 50 (e.g., with a known value or values for the vibrational response of an empty bin, so as to permit LaPlace-domain or other frequency, spectra, or response function oriented analyses). The agitator 894 acoustically stimulates the bin at least two different frequencies (including pings, discrete frequencies or a continuous sweep), e.g., which can serve to compensate for loads of varying consistency, density or other potentially confounding factors. The robot 11 includes an analyzer 896 configured to analyze vibration or resonance data detected by the vibration or resonance sensor 892 in response to the acoustical stimulation of the bin 50 by the agitator or sonic emitter 894 and to indicate when the bin 50 is full to capacity.

In some examples, at various periods the agitator 894, under the control of the analyzer circuit 896, perturbs the air remaining within the bin 50 with a known vibration strength. At the same time, the vibration sensor 892 measures a vibration response of the air in the bin 50 and transmits the measured values to the analyzer circuit 896. With respective known empty and full characteristic vibration responses of the bin 50, the analyzer circuit 896 analyzes the response from the vibration sensor 892 using methods such as frequency-domain transforms and comparisons (e.g., LaPlace or Fourier transforms, etc.) and returns an appropriate bin state.

When an acoustic signal is emitted from an acoustic emitter 894 at time T1, the transmitted signal initially traverses the interior of the bin 50 from the acoustic emitter 894 to an acoustic detector 892 located horizontally opposite the acoustic emitter 894. At time T2, the signal is detected by the transmissive acoustic detector 892A, after one time period $\tau$1 has elapsed. The acoustic signal also reflects off the interior surface 55 of the bin 50 and re-traverses the interior of the bin 50 until it is received by the reflective acoustic detector 892B at time T3, following another time period equal to $\tau$1. When the detectors 892A and 892B are of similar sensitivity, the signal detected at time T3 is lower than the signal detected at time T2 (the difference in amplitude between the signal detected at T2 and the signal detected at T3 is referred to as $\Delta$1).

A similar signal analysis is performed when the interior the bin 50 is full of debris. The signals received by the detectors 892A and 892B at times T2 and T3, respectively, may decline monotonically with respect to the initial signal emitted from emitter 894 at time T1. However, the amplitude difference between the signals detected at T2 and T3, designated $\Delta$2, is greater than a corresponding amplitude difference $\Delta$1. A time-of-flight that elapses as the acoustic signal traverses the interior of the bin 50 (herein referred to as $\tau$2) is also greater than the time period $\tau$1 corresponding to the bin-empty state. The bin-full state can be determined using a signal analysis when a signal emitted from the acoustic emitter 894 and detected by the transmissive acoustic detector 892A and the reflective acoustic detector 892B is compared to a bin empty condition (which may be initially recorded as a reference level when the bin is known to be empty, for example).

Any of these fore-mentioned methods for detecting, measuring, inferring or quantifying air flow and/or bin capacity may also be combined in any suitable permutation thereof, to further enhance the accuracy of bin capacity measuring results; in particular, for example, at least two differing bin capacity-measuring techniques may be employed such that if there is a weakness in one of the techniques—for example, where air flow may be halted due to a factor other than bin fullness, a straight pressure transducer might still produce accurate measurements of bin capacity, etc.

Figure 9A:
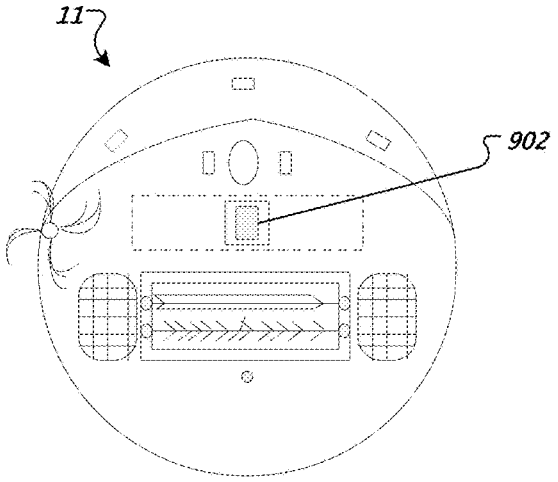
FIG. 9A is a bottom view of an autonomous robotic cleaner.
Figure 9B:
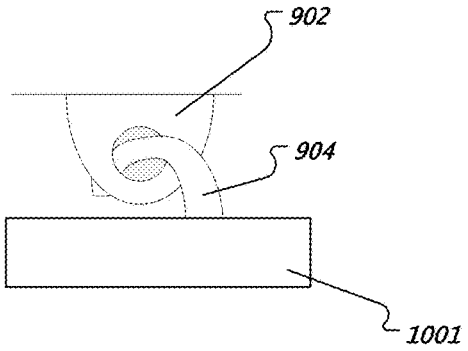
FIG. 9B is a perspective view of a robot locking device.

Referring to FIGS. 9A-B, in some implementations, a clip catch 902 is installed on the bottom of the robot chassis 31 and configured to mate with a clip 904 on a maintenance station 1250. The clip 904 engages the catch 902 to lock the robot 11 in place during servicing of the bin 50 and/or brushes or rollers 60, 65.

Existing robots 11 which do not include bin-sensing features may be retrofitted with a bin 50 including a bin-full sensor system 700. Signals generated by the bin-full sensor system 700 are transmitted to the robot microprocessor 245 (e.g. via snap-in wires, a serial line, or a card edge for interfacing a bus controlled by a microcontroller; using wireless transmission, etc.). Alternatively, an existing actuator (e.g. a fan) monitored by the home robot is "hijacked" (i.e., a property of it is modified for new use). For example, when the bin 50 is full, a cleaning assembly microprocessor 215 energizes the fan motor in a pattern (e.g., three times in a row with predetermined timing). The retrofitted and firmware-updated robot processor 245 detects the distinctive current pattern on the fan and communicates to a user that the bin 50 is full. In another example, an existing sensor is "hijacked." For example, an IR emitter disposed on top of the bin 50 in a visible range of an omnidirectional virtual wall/docking sensor. A distinctive modulated IR chirp or pulse train emitted by the retrofitted bin 50 indicates that the bin 50 is full without overwhelming the virtual wall sensor. In yet another example, communications are made just to the user but not to any automated system. For example, a flashing light on the bin 50, or a klaxon or other audio signaler, notifies the user that the bin 50 is full. Such retrofitting is not necessarily limited to the bin-capacity-sensing function, but may be extended to any suitable features amenable to similar retrofitting.

Using a manufacturer's server, a robot user may create a website containing information regarding his or her customized (or standard) robot 11 and share the information with other robot users. The server can also receive information from robots 11 pertaining to battery usage, bin fullness, scheduled cleaning times, required maintenance, cleaning patterns, room-size estimates, etc. Such information may be stored on the server and sent (e.g. with other information) to the user via e-mail from the manufacturer's server, for example.

Figure 10A:
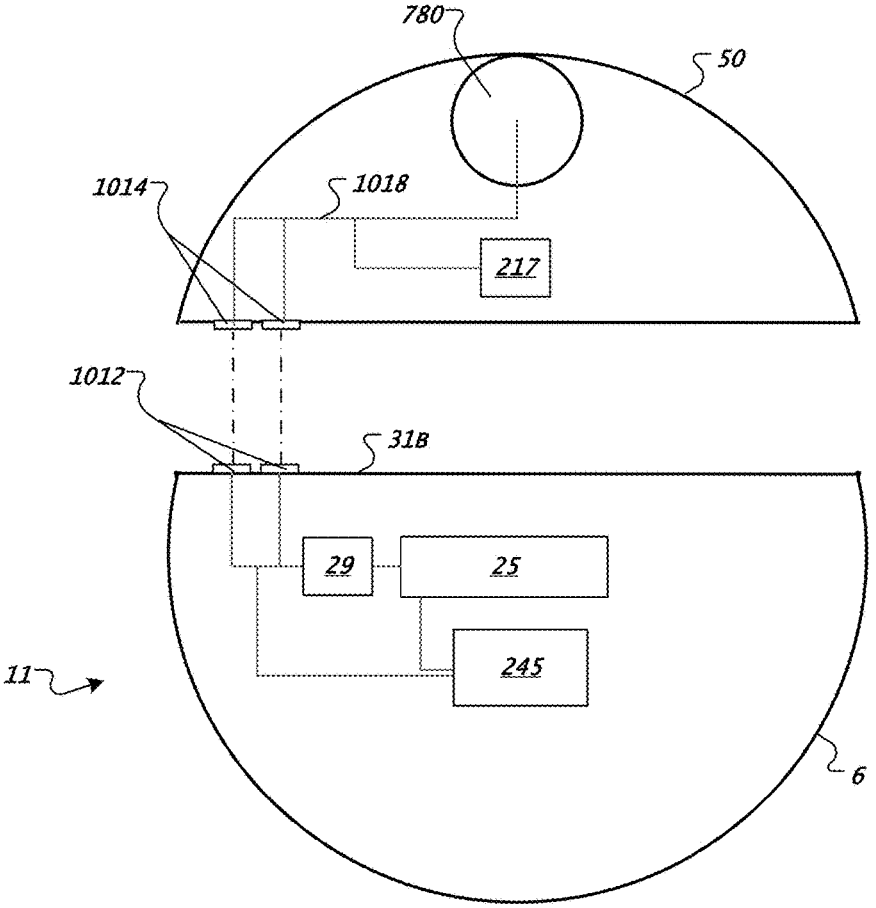
FIGS. 10A-10B are schematic views of autonomous robotic cleaners.
Figure 10B:
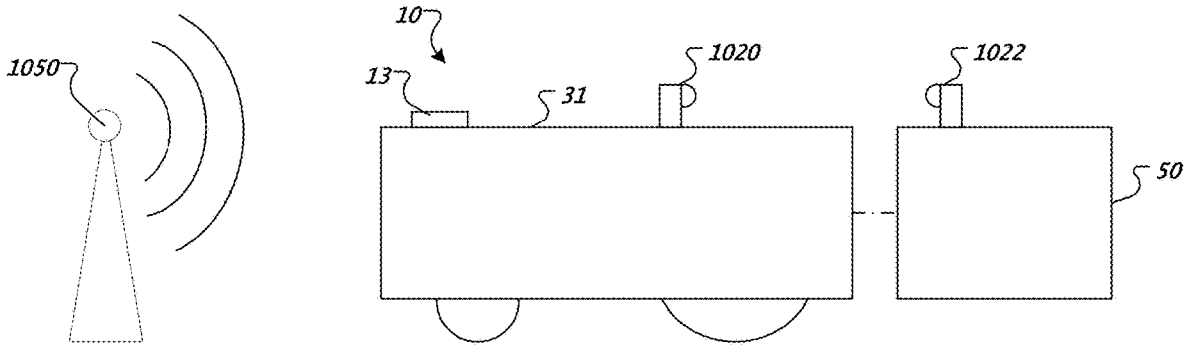

Referring to FIGS. 10A-10B, in some implementations, the robot 11 includes robot communication terminals 1012 and the bin 50 includes bin communication terminals 1014. When the bin 50 is attached to the robot 11, the bin communication terminals 1014 contact the corresponding robot communication terminals 1012. Information regarding bin-full status is communicated from the bin 50 to the robot 11 via the communication terminals 1012, 1014, for example. In some examples, the robot 11 includes a demodulator/decoder 29 through which power is routed from the battery 25 through via the communication terminals 1012, 1014 and to the bin 50. Bin power/communication lines 1018 supply power to a vacuum motor 780 and to a bin microcontroller 217. The bin microcontroller 217 monitors the bin-full status reported by the debris detection system 700 in the bin 50, and piggybacks a reporting signal onto the power being transmitted over the bin-side lines 1018. The piggybacked reporting signal is then transmitted to the demodulator/decoder 29 of the robot 11. The microprocessor 245 of the robot 11 processes the bin full indication from the reporting signal piggybacked onto the power lines 1018, for example. In some examples, the communication terminals 1012, 1014 include serial ports operating in accordance with an appropriate serial communication standard (e.g. RS-232, USB, or a proprietary protocol). The bin microcontroller 217 monitors the bin-full status reported by the debris detection system 700 in the bin 50 independent of a robot controller, allowing the bin 50 to be used on robots without a debris detection system 700. A robot software update may be required for the bin upgrade.

Referring to FIG. 10B, in some implementations, the robot 11 includes an infrared light (IR) receiver 1020 and the bin 50 includes a corresponding IR emitter 1022. The IR emitter 1022 and IR receiver 1020 are positioned on the bin 50 and robot 11, respectively, such that an IR signal transmitted from the IR emitter 1022 reaches the IR receiver 1020 when the bin 50 is attached to the robot 11. In some examples, the IR emitter 1022 and the IR receiver 1020 both functions as emitters and receivers, allowing signals to be sent from the robot 11 to the bin 50. In some examples, the robot 11 includes an omni-directional receiver 13 on the chassis 31 and configured to interact with a remote virtual wall beacon 1050 that emits and receives infrared signals. A signal from the IR emitter 1022 on the bin 50 is receivable by the omni-directional receiver 13 and/or the remote virtual wall beacon 1050 to communicate a bin fullness signal. If the robot 10 was retrofitted with the bin 50 to and received appropriate software, the retrofitted bin 50 can order the robot 10 to return to a maintenance station for servicing when the bin so is full.

Figure 11A:
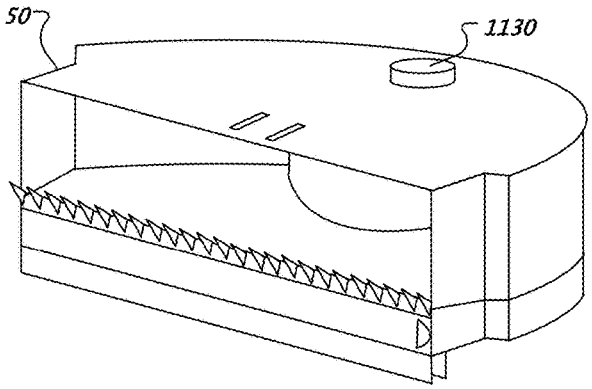
FIG. 11A is a perspective view of a cleaning bin.
Figure 11B:
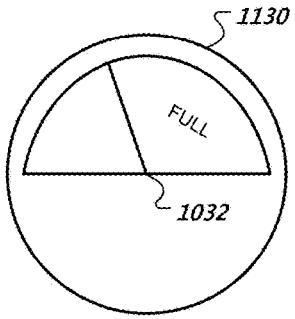
FIGS. 11B-11D are schematic views of cleaning bin indicators.
Figure 11C:
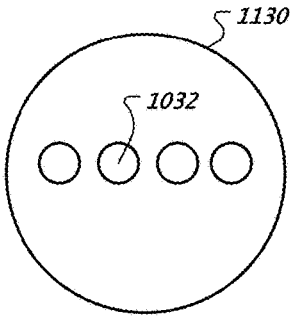
Figure 11D:
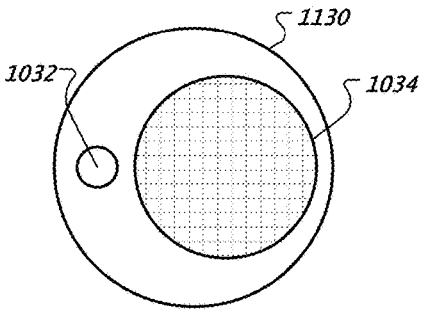

FIGS. 11A-11D illustrate a bin 50 including a bin-full indicator 1130. In some examples the bin-full indicator 1130 includes visual indicator 1132 such as an LED (FIG. 11B), LCD, a light bulb, a rotating message wheel (FIG. 11C) or a rotating color wheel, or any other suitable visual indicator. The visual indicator 1132 may steadily emit light, flash, pulse, cycle through various colors, or advance through a color spectrum in order to indicate to the user that the bin 50 is full of debris, inter alia. The indicator 30 may include an analog display for indicating the relative degree of fullness of the bin 50. For example, the bin 50 includes a translucent window over top of a rotatable color wheel. The translucent window permits the user to view a subsection of the color wheel rotated in accordance with a degree of fullness detected in the bin 50, for example, from green (empty) to red (full). In some examples, the indicator 30 includes two or more LEDs which light up in numbers proportional to bin fullness, e.g., in a bar pattern. Alternatively, the indicator 1030 may be an electrical and/or mechanical indicator, such as a flag, a pop up, or message strip, for example. In other examples, the bin-full indicator 1130 includes an audible indicator 1134 such as a speaker, a beeper, a voice synthesizer, a bell, a piezo-speaker, or any other suitable device for audibly indicating bin-full status to the user. The audible indicator 1134 emits a sound such as a steady tone, a ring tone, a trill, a buzzing, an intermittent sound, or any other suitable audible indication. The audible indicator 1134 modulates the volume in order to draw attention to the bin-full status (for example, by repeatedly increasing and decreasing the volume). In some examples, as shown in FIG. 11D, the indicator 1130 includes both visual and audible indicators, 1132 and 1134, respectively. The user may turn off the visual indicator 1132 or audible indicator 1134 without emptying the bin 50. In some implementations, the bin-full indicator 1130 is located on the chassis 31 or body 6 of the robot 11.

Figure 12A:
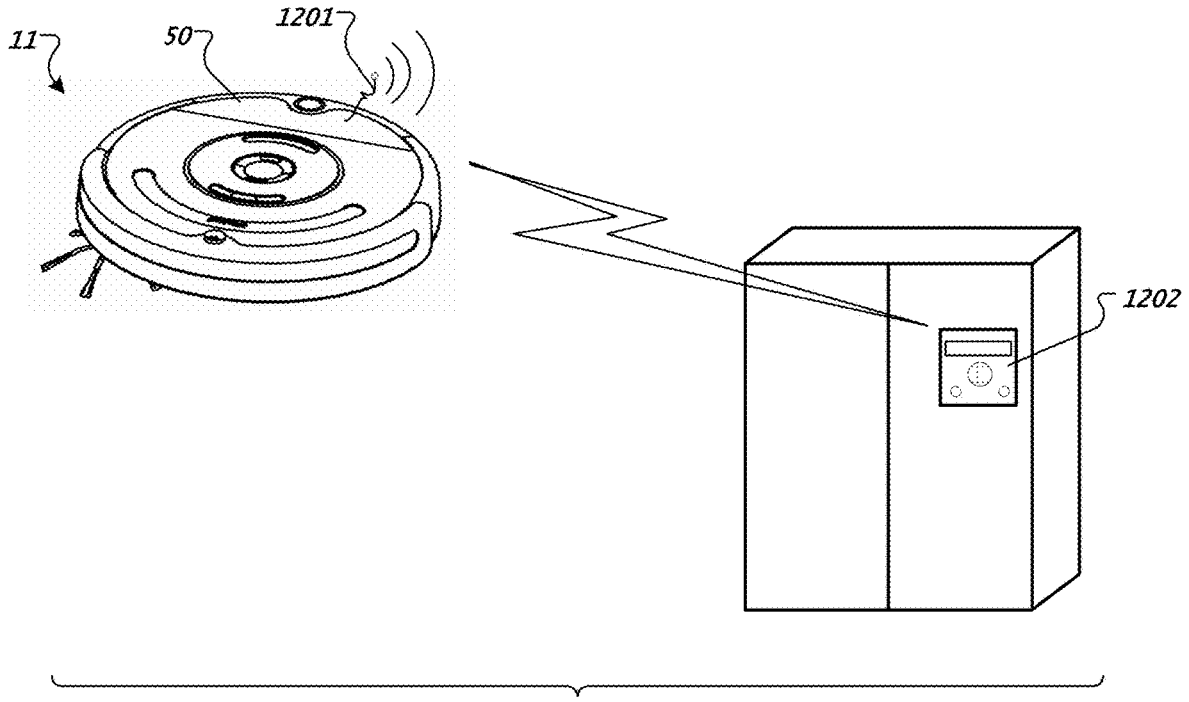
FIG. 12A is a schematic view of a cleaning bin indicator system.
Figure 12B:
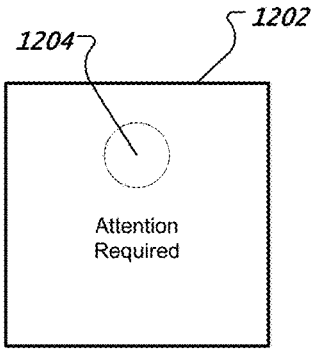
FIGS. 12B-12C are schematic views of remote cleaning bin indicators.

Referring to FIGS. 12A-12B, in some implementations, the bin 50 wirelessly transmits a signal to a remote indicator 1202 (via a transmitter 1201, for example), which then indicates to a user that the bin is full using optical (e.g. LED, LCD, CRT, light bulb, etc.) and/or audio output (such as a speaker 1202C). In one example, the remote indicator 1202 includes an electronic device mounted to a kitchen magnet. The remote indicator 1202 may provide (1) generalized robot maintenance notifications (2) a cleaning routine done notification (3) an abort and go home instruction, and (4) other control interaction with the robot 10 and/or bin 50.

An existing robot 11, which does not include any communication path or wiring for communicating with a bin-full sensor system 700 on the bin 50, is nonetheless retrofitted with a bin 50 including a bin-full sensor system 700 and a transmitter 1201. "Retrofitting" generally means associating the bin with an existing, in-service robot, but for the purposes of this disclosure, at least additionally includes forward fitting, i.e., associating the bin with a newly produced robot in a compatible manner. Although the robot 11 cannot communicate with the bin-full sensor system 700 and may possibly not include any program or behavioral routines for responding to a bin-full condition, the bin 50 may nonetheless indicate to a user that the bin 50 is full by transmitting an appropriate signal via the transmitter 1201 to a remote indicator 1202. The remote indicator 1202 may be located in a different room from the robot 11 and receives signals from the bin 50 wirelessly using any appropriate wireless communication method, such as IEEE 801.11/WiFi, BlueTooth, Zigbee, wireless USB, a frequency modulated signal, an amplitude modulated signal, or the like.

Figure 12C:
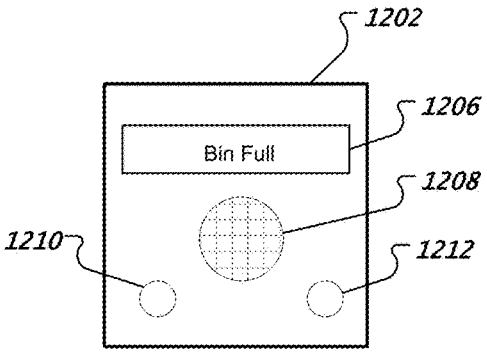

In some implementations, as shown in FIG. 12B, the remote indicator 1202 is a magnet-mounted unit including an LED 1204 that lights up or flashes when the bin 50 is full. In some examples, as shown in FIG. 12C, the remote indicator 1202 includes an LCD display 1206 for printing a message regarding the bin full condition and/or a speaker 1208 for emitting an audible signal to the user. The remote indicator 1202 may include a function button 1210, which transmits a command to the robot 11 when activated. In some examples, the remote indicator 1202 includes an acknowledge button 1212 that transmits an appropriate command signal to the mobile robot 20 when pushed. For example, when a bin-full signal is received, the LCD display 1206 may display a message indicating to the user that the bin is full. The user may then press the button 1212, causing a command to be transmitted to the robot 11 that in turn causes the robot 11 to navigate to a particular location. The user may then remove and empty the bin 50, for example.

In some examples, the remote indicator 1202 is a table-top device or a component of a computer system. The remote indicator 1202 may be provided with a mounting device such as a chain, a clip or magnet on a reverse side, permitting it to be kept in a kitchen, pendant, or on a belt. The transmitter 1201 may communicate using WiFi or other home radio frequency (RF) network to the remote indicator 1202 that is part of the computer system 1204, which may in turn cause the computer system to display a window informing the user of the bin-full status.

Figure 12D:
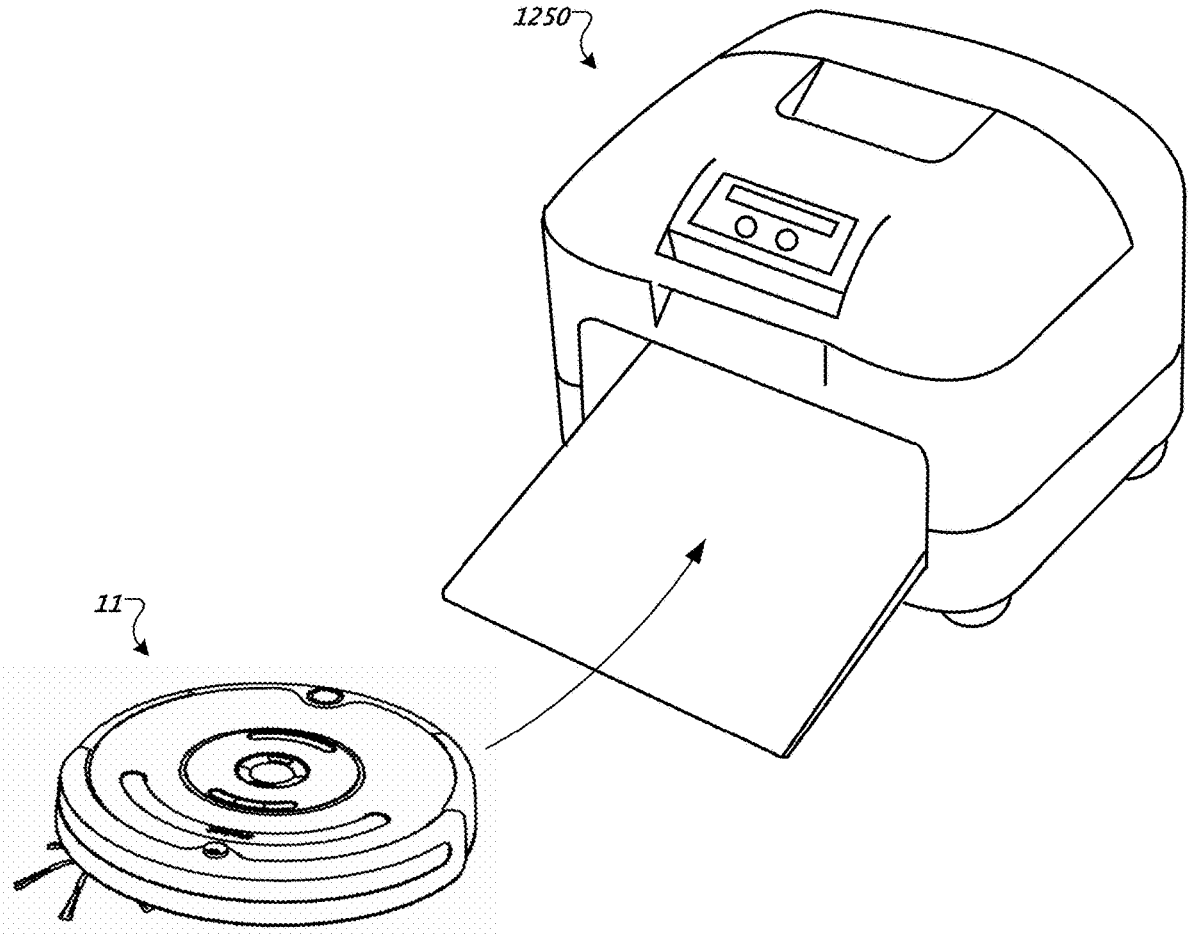
FIG. 12D is a schematic view of an autonomous robotic cleaner and an evacuation station.

Referring to FIG. 12D, when the bin-full detection system 700 determines that the bin 50 is full and/or the roller full sensor assembly 85 determines that the cleaning head 40 is full, the robot 11, in some examples, maneuver to a maintenance station 1250 for servicing. In some examples, the maintenance station 1250 automatically evacuates the bin 50 (e.g. via a vacuum tube connecting to an evacuation port 80, 305, 380, 415, 420, 425, 430 of the bin 50). If the cleaning head 40 is full of filament, the robot 11 may automatically discharge the cleaning brush/flapper 60, 65 for either automatic or manual cleaning. The brush/flapper 60, 65 may be fed into the maintenance station 1250, either manually or automatically, which strips filament and debris from the brush/flapper 60, 65.

FIGS. 13-32 illustrate methods for controlling the bin-full detection and user-notification systems of the robot 11. Steps or routines illustrated with dashed lines are expressly optional or include optional sub-routines. In some cases, steps may be omitted depending upon whether the bin is powered by its own battery or by a discharging capacitor.

Figure 13:
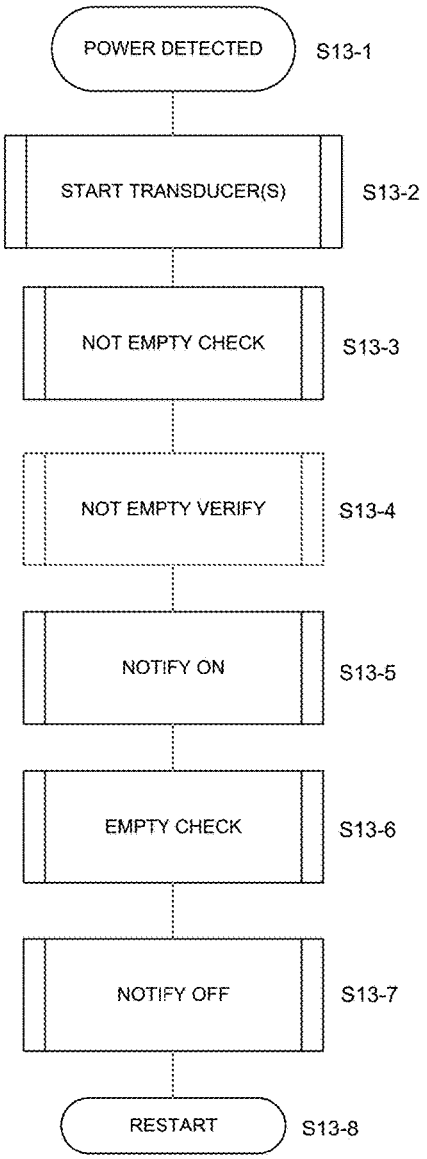
FIGS. 13-32 are process flow charts of bin-fullness detection systems.

A normal operating routine begins, as illustrated in FIG. 13, by activating transducers (e.g. bin detection system 700) to detect a bin full condition. The core operating cycle of the bin 50 takes place while the robot 11 is operating (e.g. cleaning), in order to detect a bin full condition. However, optional cycles check the status of the bin 50 and robot 11 when the robot 11 is not operating.

Figure 14:
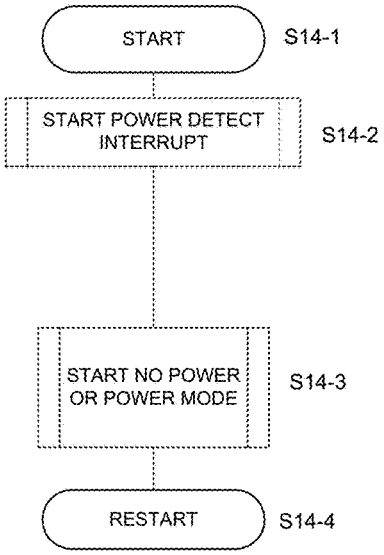
Figure 15:
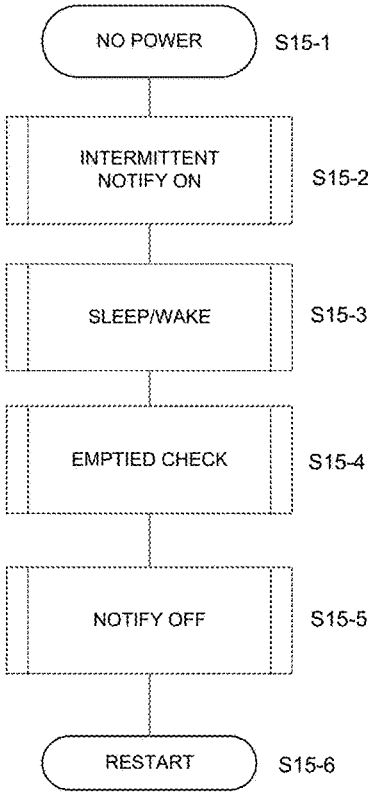

For example, the bin processor 217 may have an idle or low-power mode that is active when the robot 11 is not powered and/or the bin 50 is detached. FIGS. 14 and 15 illustrate parent procedures used to enter this mode. For example, the controller 217 may start an optional power detect routine at step S14-2. "Power detect" in this context is detecting whether or not the bin 50 is attached to the robot 11 and the robot 11 is operating (cleaning). If power is detected/available, the bin 50 enters the normal operating mode (described below). If no power is available, then the bin controller 217 executes a no-power routine, as illustrated in FIG. 15.

In the no-power mode, the bin 50 may have set a flag specifying notification is to be activated. If this is the case, a low-power notification is preferable. An optional step S15-2 would change the notification from a continuous to a more intermittent notification (rapid flashing to slower flashing, continuous on to flashing, i.e., from a higher power consumption notification to a lower power consumption notification). This is less important when the bin 50 does not rely on robot power to recharge its own power supply.

Another optional step in the no-power routine is a sleep/wake check, as shown in step S15-3. If the bin 50 maintains the intermittent or regular notification S15-2 (i.e., each step in the no-power routine is independent and optional, and may or may not depend on the execution of preceding steps), the bin 50 may enter a sleep state after a certain number of no-power (robot off), no-change (bin not disconnected from robot, bin not moved, no change in bin sensor states) minutes (e.g., 5 mins to 1 hour) elapses. The bin may wake upon disconnection from the robot 11, movement of the bin 50 or robot 11, any relevant change in bin sensor states; and may re-activate or activate checking and wake-state activities.

Another optional step in the no-power routine is an emptied check S15-4, which checks whether conditions reflect that the bin 50 has been emptied (including changes in internal sensor state indicative of emptying, tilt sensing, assumptions made). A subsequent step upon detection of bin emptying directly or indirectly is the deactivation of the notification (step S15-5) and resetting or restarting the processes.

Referring again to FIG. 13, if power is detected, i.e., if the bin is connected to the robot 11 and the robot 11 is operating, transducer(s) are started at step S13-2. "Transducers," in this context, describes various instruments and sensors as described herein that are used to directly or indirectly check whether the bin is full and/or not empty. This includes virtual transducers. Step S13-2 initiates bin monitoring via the transducer(s) until monitoring is no longer necessary.

Once the transducers are active, a not empty check is executed at step S13-3. "Not empty", in this context, describes positive, negative, and inferred sensor interpretations that may directly or indirectly check whether the bin is full, empty, and/or not empty and/or not full. Steps S13-2 and 13-3 starts, and continues, a not-empty check via the transducer(s) until the same is registered, and may constitute the only such check, i.e., confirmation or verification is optional.

Optionally, a not empty verify routine may be executed at step S13-4. "Verify," in this context, describes repeating or extending the checks performed in step S13-3, or a different kind of check upon a same or different kind of criteria. A preferred example of the step S13-4 correlates verification with sufficient elapsed time under a positive not-empty condition. Optionally, step S13-4 includes routines to reject false positives.

Once the not-empty or bin full state is detected and optionally checked as stable, in one direction or the other, the controller 217 may activate notification in step S13-5. The notification may be kept on for a certain time period, and/or may be kept on until the bin is detected as emptied at step S13-6. Notification is turned off at step S13-7. Thereafter, the process is restarted at S13-8.

Examples of start transducer routines are illustrated in FIGS. 16-20. Each routine includes appropriate calibration/tare/zeroing steps.

Figure 16:
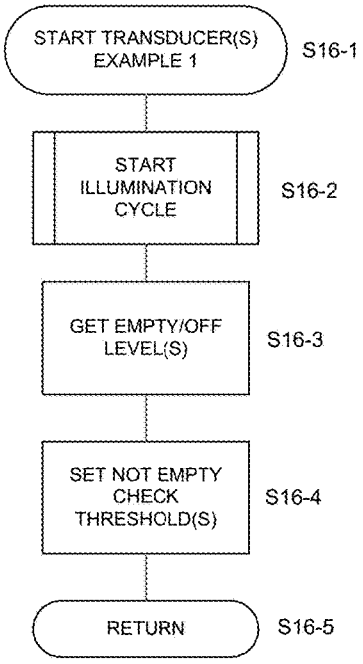
Figure 17:
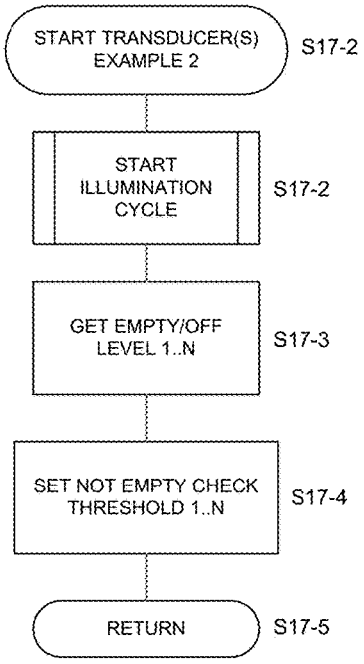
Figure 32:
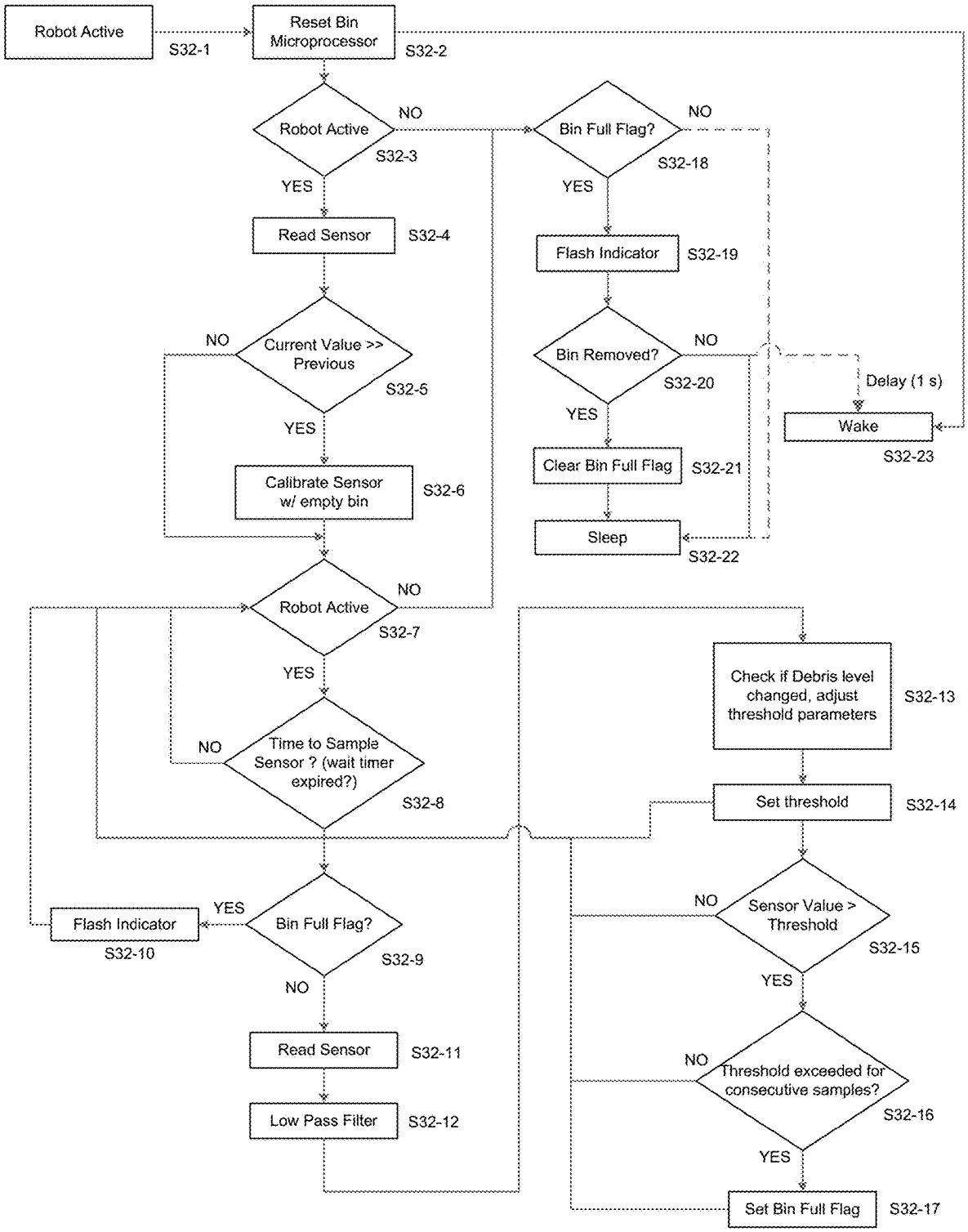

FIG. 16 illustrates an example start transducer routine appropriate for a single or combined/averaged illuminated emitter and or detector array in the bin 50, either of the reflective type or break-beam/transmissive type. A start illumination cycle routine is executed at step S16-2. Empty/off levels are sampled from bin detectors and averaged at step S16-3. A not empty check threshold is set at step S16-4, before the process is returned at step S16-5. As illustrated in FIG. 17, a similar process is executed in start transducer example 2 routine, in which empty/off levels are sampled for a set of 1 to N transducers. Each emitter/detector pair or combination is accounted for in the calibration or normalizing of empty or off levels in step 17-3. FIG. 32 contemplates the case in which the same sensors are checked for different orientations, or combinations, or cycled time-wise, e.g., emitter A1 with detector B1, emitter A1 with detector B2, emitter A2 with detector B1. The start transducer example 2 routine is appropriate when the same sensors in the emitter and/or detector arrays can identify sensor failure, or debris jams or clumps in the bin 50.

Figure 18:
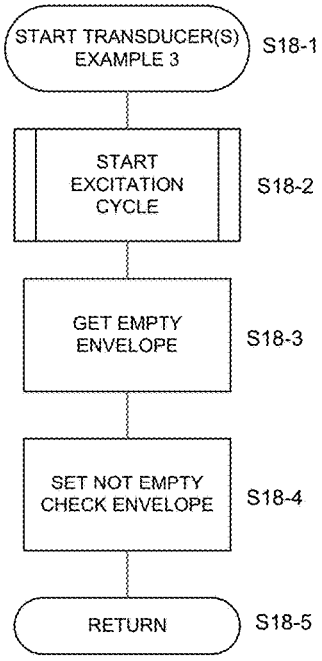
Figure 19:
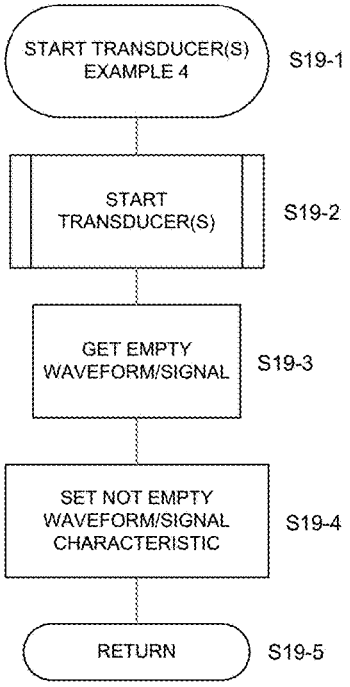

FIGS. 18-19 illustrate example start transducer routines, in which an excitation cycle is started at step S18-2 or S19-2. These routines are appropriate for bin detection systems 700 including hot-wire anemometers or thermistors, vibration sensors, time-of-flight acoustic measurements, or transducers that generate a signal in which the empty or full state that has a relatively more complex characterization. Calibration at step S18-3 or S19-3 may require identifying an empty waveform, signal, or envelope characteristic representing a range, envelope, or signal shape of transducer detection values corresponding to an empty bin 50. The characteristic envelope is a baseline for measurements in step S18-4 or S19-4. An intervening optional step can model, fit, or transform the shape or envelope so that less data is necessary for storage or comparison purposes.

Figure 20:
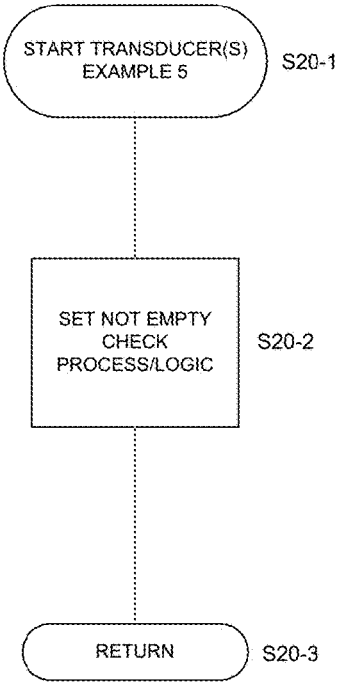

FIG. 20 illustrates an example start transducer routine appropriate for an arrangement in which transducers are not calibrated, and/or in which heuristics, filters, and/or other non-linear rules are used to identify the bin full state. The transducers may nonetheless be normalized or calibrated.

Figure 21:
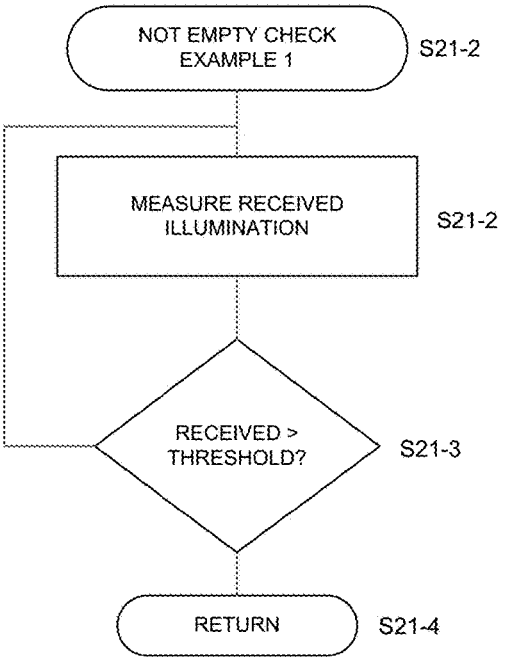

FIGS. 21-24 illustrate example not empty check routines. FIG. 21 provides an example not empty check routine appropriate for a single or combined/averaged illuminated emitter and or detector array in the bin 50. Illumination received by the detector of the transducer is measured at step S21-2. The measured illumination is compared to a threshold illumination level corresponding to the bin empty state in step S21-3. If received illumination is below the threshold, the process loops back to step S21-2. Otherwise, the routine returns at step S21-4.

Figure 22:
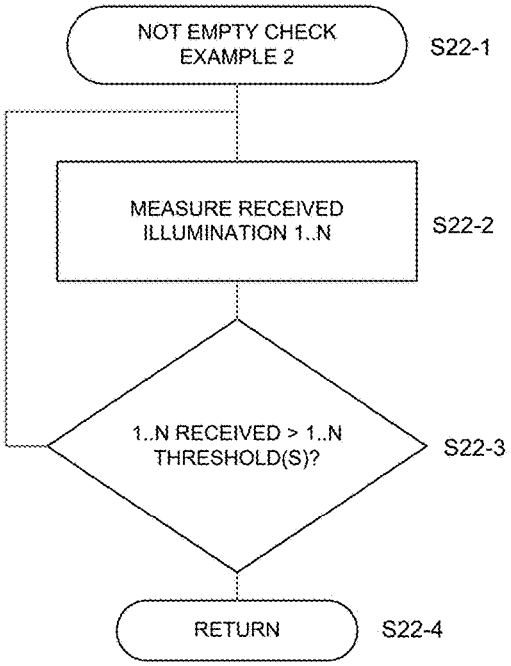

FIG. 22 provides a second example not empty check routine appropriate for a matrix of transducers. Illumination received by a set of 1 to N transducers is measured in step S22-2. The received illumination of the 1 to N transducers is compared to a set of 1 to N threshold levels is step S22-3. If received illumination is below the threshold, the process loops back to step S22-2. Otherwise, the routine returns at step S22-4.

Figure 23:
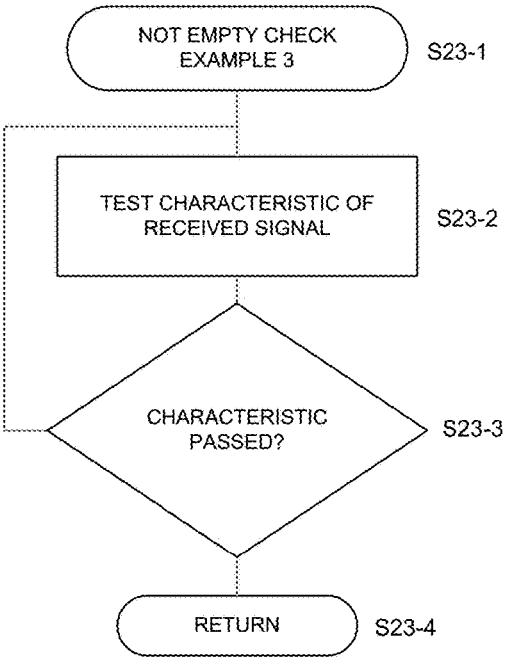

FIG. 23 illustrates a third example not empty check routine, in which characteristics of a received signal of a transducer are tested at step S23-2. A determination of whether the tested characteristic passes the not empty check is made at step S23-3. If the tested characteristic of the received signal passes, the routine returns at step S23-4; otherwise, the process repeats step S23-2.

Figure 24:
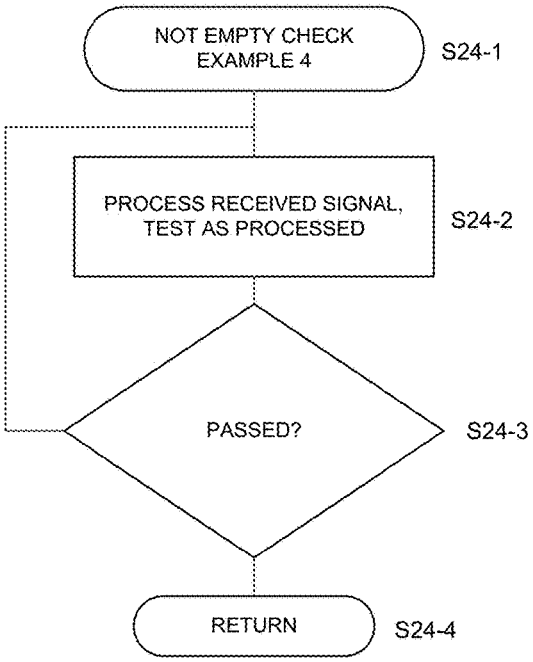

FIG. 24 illustrates a fourth example not empty check routine, in which a signal received by a transducer is processed and tested as it is processed at step S24-2. If the ongoing testing of the signal passes at step S24-3, the routine returns at step S24-4; otherwise, the routine repeats step S24-2.

Figure 25:
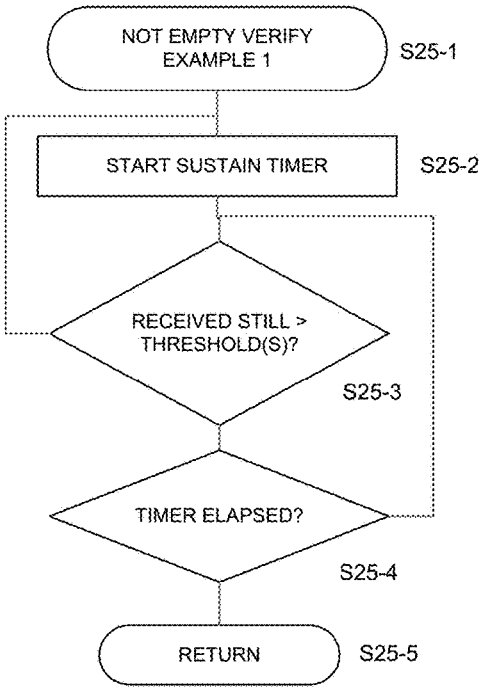

FIGS. 25-28 illustrate example not empty verification routines. FIG. 25 illustrates one example not empty verification routine including a start sustain timer (e.g., 5 mins) step S25-2. In step S25-3, it is determined whether a received signal of a transducer remains above a threshold level. The sustain timer sets the period for which the not-empty detection must continue in order to establish the stable bin full condition. If the received signal of the transducer continues to be above a threshold level at step S25-3, it is then determined whether the timer has elapsed at step S25-4. If the timer has elapsed, the stable bin full condition is established and the routine returns at step S25-5. If the timer has not yet elapsed, the routine loops back to step S25-3 to check whether received signals at the transducer remain above the threshold.

Figure 26:
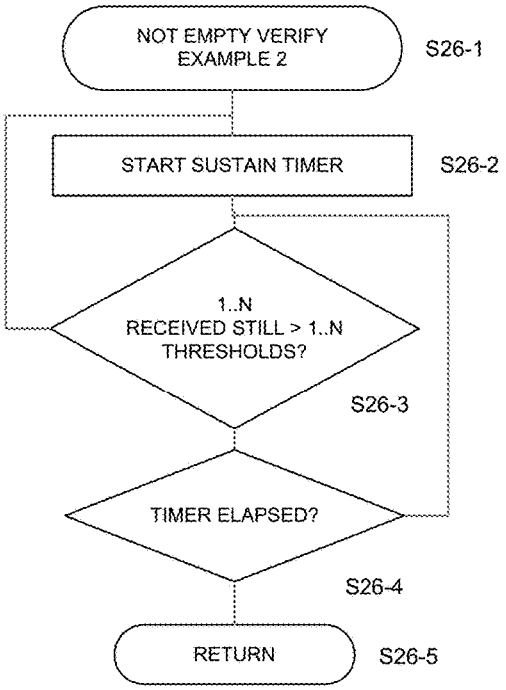

FIG. 26 illustrates a second example of a not empty verification routine, in which the received signals of a set of 1 . . . N transducers are compared to a set of 1 . . . N thresholds in step S26-3. If any sensor falls below the threshold, the sustain timer is restarted at step S26-2.

Figure 27:
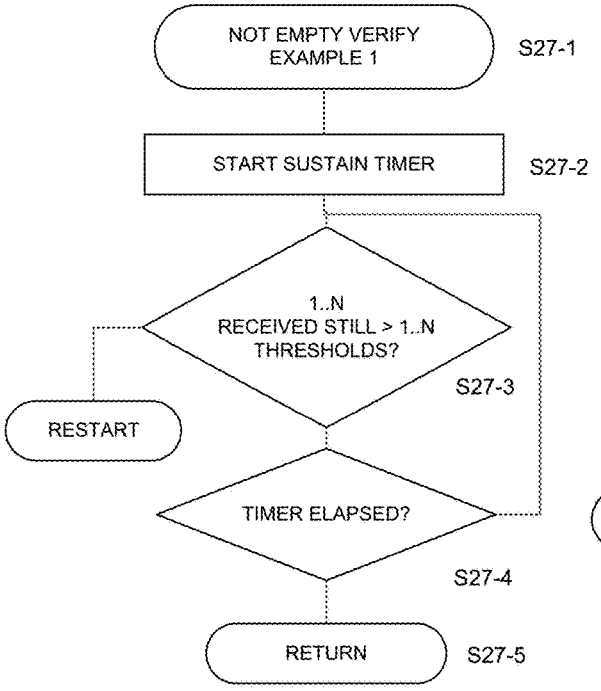

In a third example, illustrated in FIG. 27, when any transducer falls below the threshold level at step 27-3, the verification process, the entire not empty check procedure, and the initial bin full detection is restarted.

Figure 28:
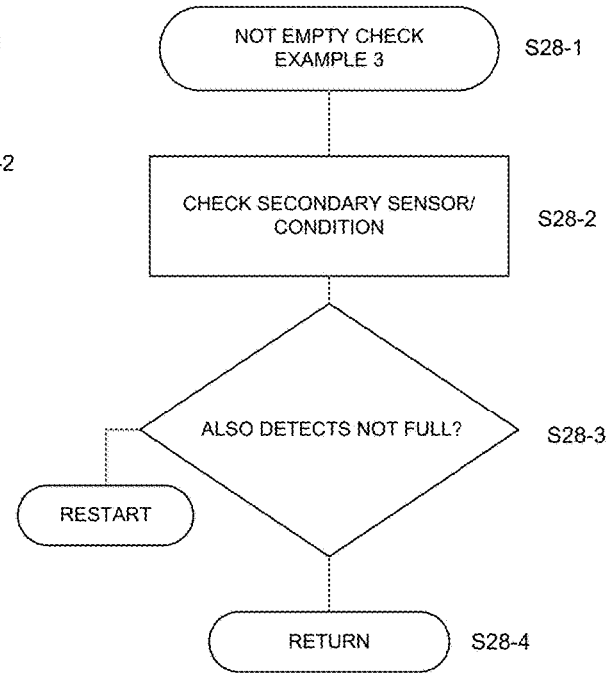

A fourth example of a not empty check routine is illustrated in FIG. 28, in which a secondary sensor or a condition is tested at step S28-2. The secondary sensor may be the same kind of transducer as the primary transducer in the same location for redundancy, or the same kind of transducer in a different location for confirmation, or a different kind of transducer in the same or a different location. If it is determined that that the secondary sensor also does not detect a full condition in step S28-3, the process is restarted.

Figure 29:
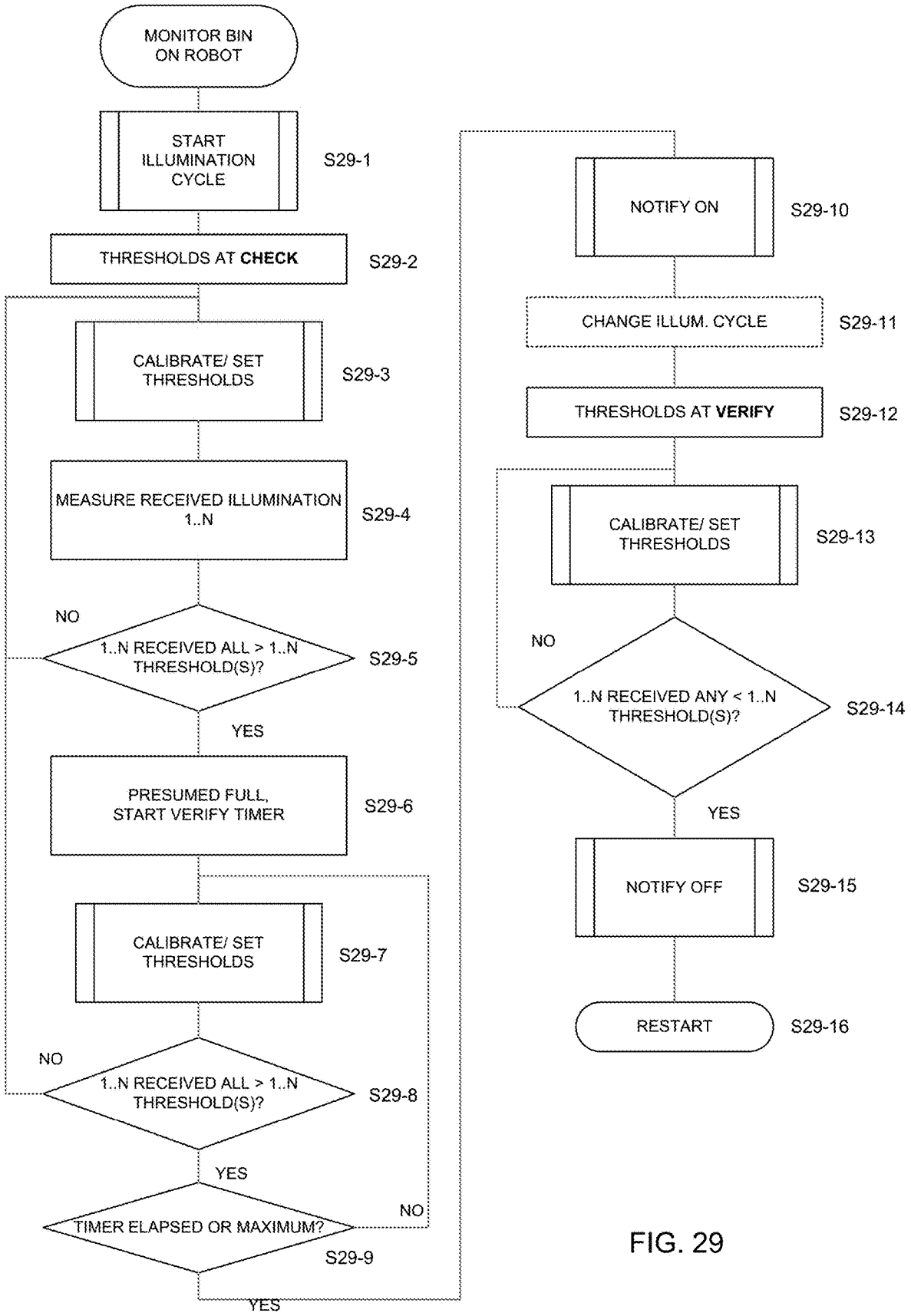

FIG. 29 illustrates a routine for monitoring debris content of the bin 50. The routine is a specific example of an entire integrated process such as the general process discussed with reference to FIG. 13, and includes a specific example including two or more LED emitters and two (or more) collectors disposed in the bin 50. When "80% of dark level" is discussed, the meaning may be (a) 80% of a negative value or (b) 80% of a variable meaning "darkness" rather than a direct measurement of voltage or current. For example, a full dark score may be 100, recorded upon calibration when illumination is off, and a full light score may be 0, recorded upon calibration when illumination is on and unobstructed. 80% of the absolute dark level would be a score of 80 (mostly dark). Alternatively, a light score may be used, which may also take into account accumulated dirt on the sensors and emitters. In this case, 80% of the absolute dark level may be replaced by 20% of the value recorded upon calibration when illumination is on and unobstructed.

At step S29-1, an illumination cycle of a transducer is started. For example, the emitters 755 may be activated and the transmitted signal detected by detectors 760, when it is known (or assumed) that the bin 50 is empty. The thresholds are then checked and set to the detected values at step S29-3. For example, each threshold is set proportional to a dark reading with the lights off.

In a measuring step S29-4, the illumination signal received by each transducer 1 . . . N (e.g., the detectors 760) is measured. In step S44-5, it is determined whether the received illumination is greater than a corresponding set of threshold values. The thresholds are set as a score to be exceeded, but may be set as a negative or low dark current value checked via a greater than or less than comparison. For example, a full bin 50 may register 80% of the absolute dark score in each compartment. The comparison step is intended to detect a nearly absolute dark level, even when the lights are illuminated, when most of the light is being blocked by debris. If one of the receivers is below the threshold (registers a dark level less than expected for a full or near-full bin), the routine returns to step S29-3 (e.g., at least one side is not full or nearing full). Otherwise, the routine proceeds to step S29-6, in which the bin 50 is presumed full and a verification timer is started. At step S29-7, the illumination cycle continues, and the thresholds remain the same, set to a less sensitive level, or decaying slowly. At step S29-8, it is determined whether the received signals are greater than the set of thresholds (e.g., all sensors continue to read more than 80% of a full dark level). If one of the received signals fails the threshold test, the process may return to S29-2 to restart the check process (i.e., the stability test fails, and the entire check restarts, including the "first" detection of all sensors almost dark).

Alternatively, the process returns to S29-7 rather than S29-2, i.e., the stability test is set to register a bin full after a continuous detection of almost full over a certain period time for all the sensors. In this case, rather than restarting the check for a "first" bin full detection, the verify timer may be restarted in step S29-6 when transient non-full conditions are detected. A bin-full state is notified after a consistent full condition is detected.

In either case, after the bin 50 (e.g. each side of the bin 50) has registered an almost full dark condition for the specified verify timer period, checked in step S29-9, a bin-full notification is turned on at step S29-10 in order to indicate to the user that the bin is full. Optionally, at step S29-11, the illumination cycle may be altered or changed, in order to reduce power consumption or to check for an emptied bin 50 more or less often than a full bin 50.

The thresholds for the verification steps are set at step S29-12. The thresholds may be set to a dark level that is less dark than previously employed. The verify level in step S29-12 is not the same as the verification timer of steps S29-6 or S29-9, and in this case is a verification that the bin 50 has not yet been emptied. This level is set to, e.g., 50% of the full dark score, to detect an emptied condition when either sides of the bin 50 has a sufficient increase in detected illumination. A significant amount of material must be removed from the bin 50 for either side to reach a level where a sensor receives, e.g., 50% of illumination received in an unobstructed condition, or 50% greater illumination than when the sensors are in an absolute dark level condition. The thresholds are calibrated or set at step S29-13 on every cycled, e.g., the dark level is set with reference to a no-illumination state. If it is determined at step S29-14 that one received signals is less than the new thresholds (e.g., that all of the sensors no longer register an almost or 80% of dark condition, and at least one of them registers a partially illuminated or 50% dark condition), notification is turned off at step S29-15.

Figure 30:
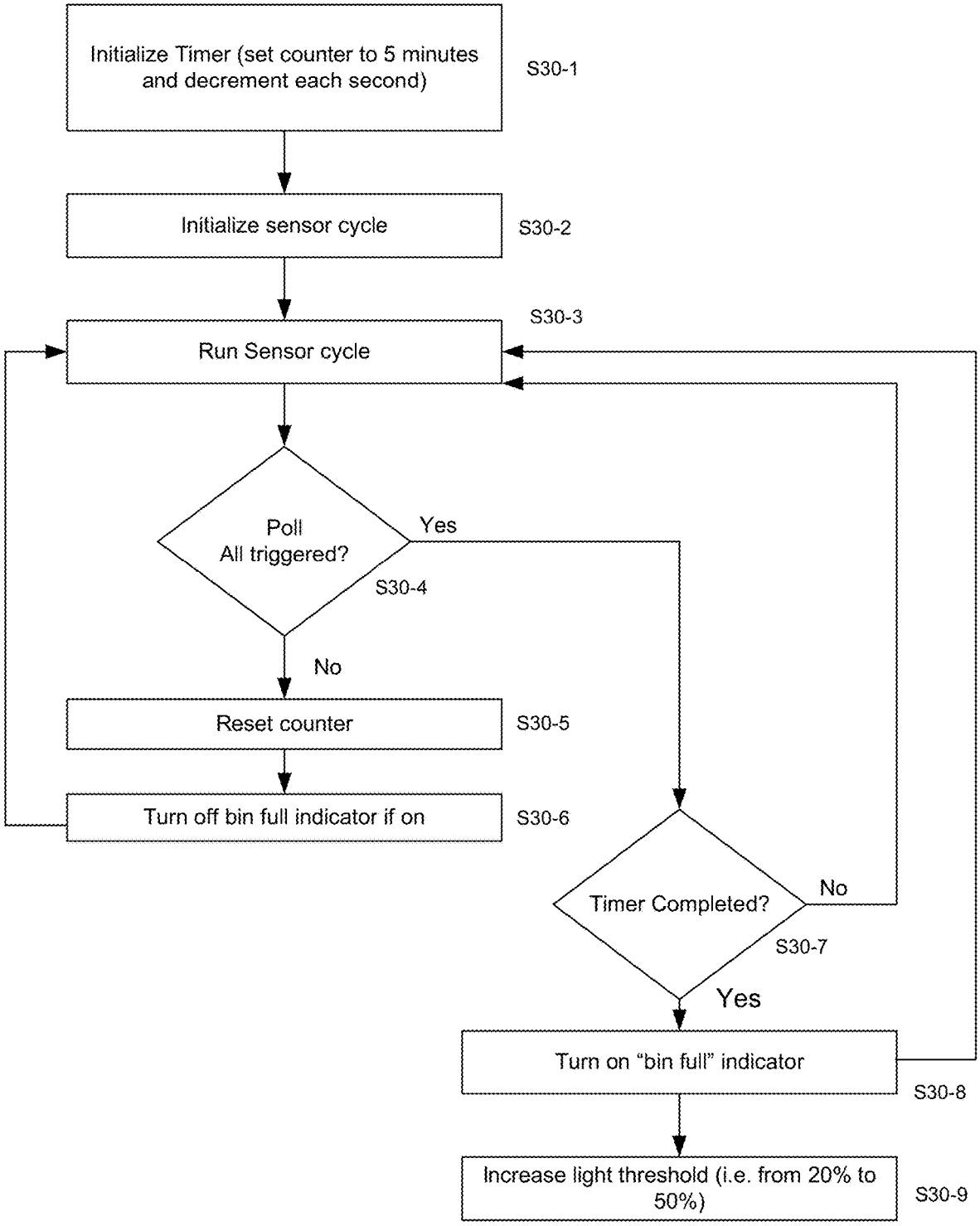

FIG. 30 illustrates a routine for operating transducers, determining the bin-full status of the bin, and turning the bin-full indicators on or off. At step S30-1, a timer is initiated by setting a counter to an initial interval (for example, 5 minutes=300 seconds) and decrementing the counter once each second (or other periodic schedule). At step S30-2, an initial sensor cycle is run to calibrate the thresholds. A main sensor cycle is run at step S30-3, in which each transducer is polled for received illumination signals, and any flags, such as a flag indicating that the bin 50 was sensed as full, are considered. At step S30-4, it is determined whether the bin-full flags have been triggered. If not, the counter is reset at step S30-5, the bin-full notification is turned off at step S30-6, and the routine returns to step S30-3. If the result of step S30-4 is positive, then it is determined at step S30-7 whether the timer has completed. If not, the routine returns to step S30-3; otherwise, the routine proceeds to step S30-8, at which the bin-full notification is turned on. The light threshold may then be increased or decreased, as appropriate, at step S30-9, for example, the light threshold may be increased from 20% to 50%, and the routine then returns to step S30-3.

By increasing the light threshold for comparison with the received illumination signal from the transducers, the sensitivity for turning the bin-full indicators on or off is decreased. The bin-full notification therefore becomes less likely to be turned off, because a more substantial change in the received illumination signal of the transducers is necessary to exceed the increased threshold. As a result, rapid shifting of the bin-full notification from on to off and back again may be avoided.

Figure 31:
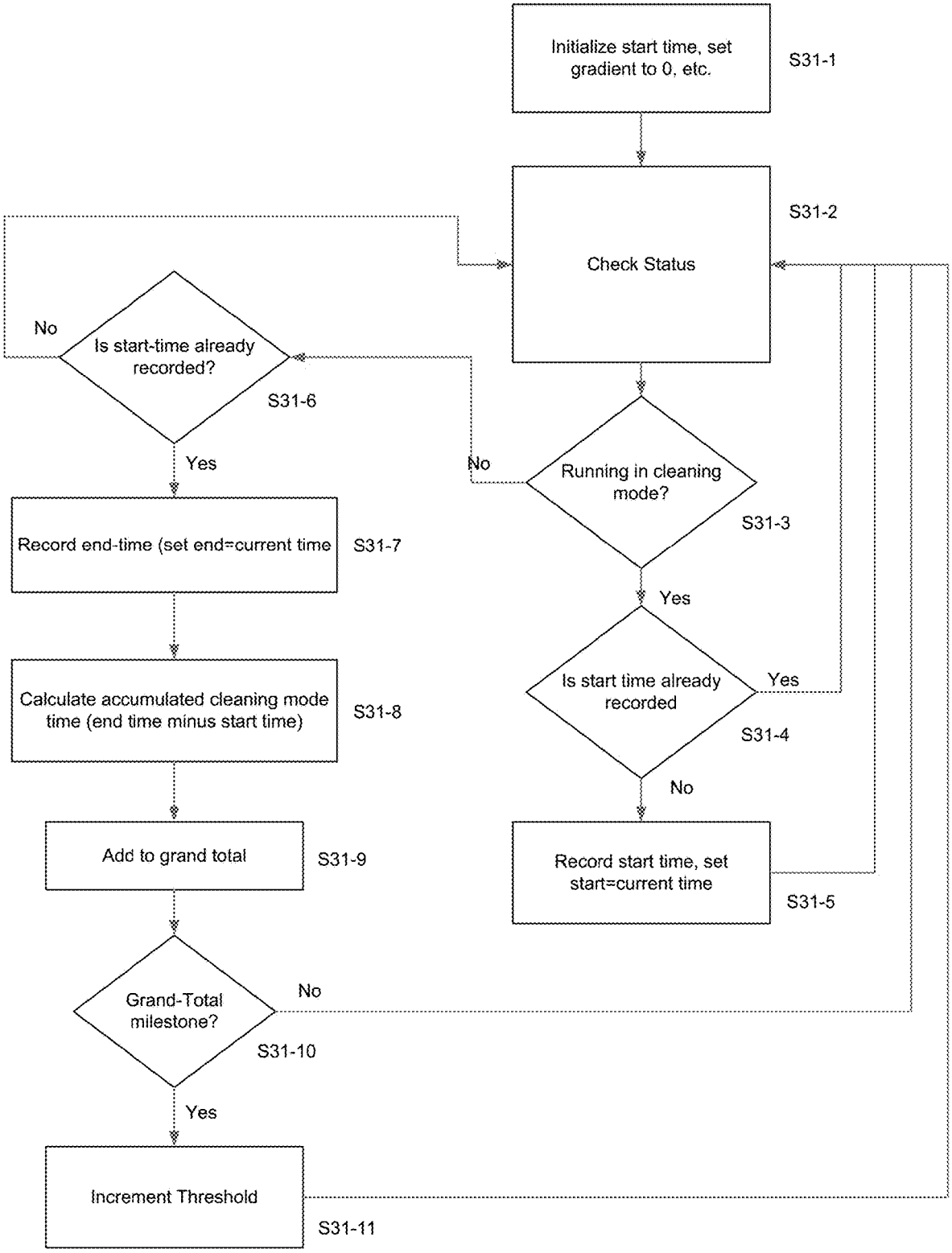

FIG. 31 illustrates another example of a control routine for the robot 11 and the bin 50. At step S31-1, the variables start time and grand_total (e.g. a total accumulation of time spent running a cleaning mode) are set to zero (or otherwise set to predetermined initial value). At step S31-2, status is checked for each of the variables, and it is determined at step S31-3 whether the robot 11 is running in a cleaning mode. If the robot 11 is running in the cleaning mode, it is then determined whether the variable start time has already been recorded (e.g. whether start time has been assigned a value different from its initialization value). If so, the process returns to step S31-2; otherwise, the process proceeds to step S31-5, and records the current time to the variable start time before returning to step S31-2. If the result of step S31-3 is negative, it is then determined at step S31-6 whether start time was already recorded. If not, the routine returns to step S31-2; otherwise, at step S31-7, the current time is recorded as a variable end time. At step S31-8, the accumulated cleaning mode time is calculated by subtracting the value of the variable start time from the value of the variable end time. At step S31-9, the accumulated cleaning time is then added to the variable grand_total. The variable grand_total represents the total amount of time the robot 11 has spent in cleaning mode since the most recent system reset.

At step S31-10, it is determined whether grand_total is greater than a milestone value. The milestone may represent a predetermined time period that may be significant, or the milestone may correspond to an arbitrarily chosen time period, for example. If the result of step S31-10 is negative, the routine returns to step S31-2; otherwise, the illumination threshold is incremented at step S31-11 in order to desensitize measurement of the polled transducer values at step S31-11, before the routine returns to step S31-2.

The sensitivity of the illumination thresholds for the transducers may be changed or modified based not only on the total amount of time the robot 11 has spent turned on, but instead, in proportion to the amount of time the robot 11 has spent in the cleaning mode. Furthermore, the criteria of whether the robot 11 is in cleaning mode or not can be defined such that the cleaning mode corresponds to times when a high level of debris intake is detected; or simply when the vacuum or sweeper motors are turned on, for example. False bin-full conditions may arise in situations where the robot 11 traverses a large (but relatively clean) area and therefore does not pick up much debris, or where the robot 11 is turned on for a long period time but does not pick up much debris. The false bin-full conditions may be avoided by focusing on the cleaning mode status rather than general run time.

FIG. 32 illustrates a process of determining bin-fullness in a cleaning bin 50. The robot 11 is active in step S32-1 and resets the bin microprocessor 217 in step S32-2. If the robot 11 is active (e.g. cleaning) in step S32-3, the bin microprocessor 217 reads the bin sensor system 700 (which may hive one or more sensor pairs) in step S32-4; otherwise, the bin microprocessor 217 checks if a bin full flag is set in step S32-18. In step S32-5, the bin microprocessor 217 compares a current sensor reading with a previous sensor reading. If the current sensor reading is much greater than (by a predetermined amount) the previous sensor reading, the bin microprocessor 217 assumes the bin 50 is empty and calibrates the sensor system 700 in step S33-6 and proceeds to step S32-7; otherwise, the bin microprocessor 217 just proceeds to step S32-7. In step S32-7, the bin microprocessor 217 determines if the robot 11 is active (e.g. cleaning). If the robot 11 is not active, the bin microprocessor 217 checks if a bin full flag is set in step S32-18. If the robot 11 is active, the bin microprocessor 217 proceeds to step S32-8 to set a timer for a predetermined amount of time. The bin microprocessor 217 periodically (or continuously) checks for expiration of the timer. If the timer has not expired, the bin microprocessor 217 proceeds back to step S32-7 to check for robot activity (without resetting the timer). If the timer has expired, the bin microprocessor 217 checks if a bin full flag is set in step S32-9. If the bin full flag is set in step S32-9, the bin microprocessor 217 updates the indicator 1130 to notify a robot user that the bin 50 is full and proceeds back to step S32-7 to check for robot activity. If the bin full flag is not set in step S32-9, the bin microprocessor 217 reads the bin sensor system 700 in step S32-11 and sends the current sensor reading through a low pass filter in step S32-12. In step S32-13, the bin microprocessor 217 checks if a debris level has charged based on the current sensor reading and adjusts the threshold parameters accordingly. The threshold parameters are set in step S32-14. If the current sensor reading is greater than the threshold in step S32-15, the bin microprocessor 217 checks if multiple readings exceed the threshold parameters in step S32-16. If current sensor reading and subsequent multiple samplings exceed the threshold parameters, the bin full flag is set in step S32-17 and the bin processor 217 proceeds back to step S32-7; otherwise, the bin processor 217 does not set the bin full flag and just proceeds back to step S32-7. In step S32-7, if the robot 11 is no longer active, the bin processor 217 proceeds to step S32-18, where it checks if the bin full flag is set. If the flag is not set, the robot 11 may proceed to a sleep mode in step S32-22. If the flag is set, the bin microprocessor 217 updates the indicator 1130 (which may flash, chirp, etc.) to notify a robot user that the bin 50 is full. In step S32-20, if the bin 50 is moved by the user, the bin full flag is cleared in step S32-21 and the robot 11 proceeds to the sleep mode in step S32-22; otherwise, the flag is not cleared and the robot 11 just proceeds to the sleep mode in step S32-23.

Other details and features combinable with those described herein may be found in the following U.S. patent applications filed concurrently herewith, entitled "CLEANING ROBOT ROLLER PROCESSING" having assigned Ser. No. 11/751,413; and "REMOVING DEBRIS FROM CLEANING ROBOTS" having assigned Ser. No. 11/751,470, the entire contents of the aforementioned applications are hereby incorporated by reference.

A number of implementations have been described. Nevertheless, it will be understood that various modifications may be made without departing from the spirit and scope of the disclosure. Accordingly, other implementations are within the scope of the following claims.

What is claimed is:

1. An autonomous coverage robot comprising:

a body;

a bin defining an inlet, the bin being releasably engageable with the body to receive debris into the bin through the inlet, wherein the inlet is substantially rectangular and is defined in a substantially vertical plane as the debris is received in the bin, the inlet comprising long sides extending in a horizontal direction and short sides extending in a vertical direction;

a first emitter supported on the body near a first short side of the short sides of the inlet and arranged to emit a signal across the inlet; and a first detector supported on the body near an opposite short side of the short sides of the inlet and arranged to receive the signal emitted by the first emitter across the inlet;

wherein the bin is movable with respect to the first emitter and the first detector.

2. The autonomous coverage robot of claim 1, further comprising:

a second emitter arranged to direct a signal across the inlet, wherein the first detector is configured to receive reflections of the signal emitted by the second emitter.

3. The autonomous coverage robot of claim 2, wherein:

the first and second emitter are arranged relative to one another such that the signal emitted by the first emitter and the signal emitted by the second emitter intersect within the inlet.

4. The autonomous coverage robot of claim 2, wherein:

the second emitter is supported on the body, and the bin is movable relative to the second emitter.

5. The autonomous coverage robot of claim 1, further comprising:

a controller supported on the body, wherein the first emitter and the first detector are each in wireless communication with the controller.

6. The autonomous coverage robot of claim 5, wherein:

the wireless communication comprises infrared communication.

7. An autonomous coverage robot comprising:

a body;

a bin defining an inlet, the bin being removably attached to the body to receive debris into the bin through the inlet, the inlet being substantially rectangular; and a debris sensing system comprising:

a first emitter mounted on the body and arranged to emit a signal across the inlet; and a first detector mounted on the body and arranged to receive the signal emitted by the first emitter across the inlet, the first emitter and the first detector being arranged near opposites sides of the inlet.

8. The autonomous coverage robot of claim 7, wherein:

the signal is a first signal, and the debris sensing system further comprises a second emitter arranged to emit a second signal across the inlet.

9. The autonomous coverage robot of claim 8, wherein:

the first detector is configured to receive reflections of the second signal emitted by the second emitter.

10. The autonomous coverage robot of claim 8, wherein:

the debris sensing system further comprises a second receiver arranged to receive the signal emitted by the second emitter.

11. The autonomous coverage robot of claim 8, wherein:

the first emitter and the second emitter are configured such that the first signal and the second signal intersect within the inlet.

12. The autonomous coverage robot of claim 7, wherein:

the inlet comprises long sides extending in a horizontal direction and short sides extending in a vertical direction.

13. The autonomous coverage robot of claim 12, wherein:

the first emitter is arranged near a first short side of the short sides of the inlet, and the first detector is arranged near a second short side of the short sides of the inlet, the second short side being opposite the first short side.

14. The autonomous coverage robot of claim 7, wherein: the first emitter and the first detector are positioned along a vacuum flow path between the inlet and a cleaning head of the autonomous coverage robot.

15. The autonomous coverage robot of claim 7, wherein: the debris sensing system is configured to measure an amount of the debris received in an intake flow path through the inlet into the bin.

16. The autonomous coverage robot of claim 7, further comprising:

one or more drive wheels configured to move the autonomous coverage robot across a floor surface; and a vacuum motor operable to draw the debris along a flow path, through the inlet, and into the bin.

17. The autonomous coverage robot of claim 16, further comprising:

a cleaning head assembly mounted to the body, the cleaning head assembly configured to direct debris toward the flow path.

18. The autonomous coverage robot of claim 17, wherein: the first emitter and the first detector are positioned along the flow path near the inlet.

19. The autonomous coverage robot of claim 7, further comprising a controller supported on the body, wherein the first emitter and the first detector are each in wireless communication with the controller.

20. The autonomous coverage robot of claim 19, wherein the controller is configured to monitor a bin-full status based on information communicated to the controller from the debris sensing system.

* * * * *